US006056083A

United States Patent [19]

Daniell

[11] Patent Number: 6,056,083

[45] Date of Patent: May 2, 2000

[54] LOUDSPEAKERS IN ARCHITECTURAL FORM

[76] Inventor: Stephen S. Daniell, 1 Cottage St., Easthampton, Mass. 01027

[21] Appl. No.: 09/017,986

[22] Filed: Feb. 3, 1998

Related U.S. Application Data

[60] Provisional application No. 60/039,099, Feb. 24, 1997.

[51] Int. Cl.[7] ..... A47B 81/06

[52] U.S. Cl. ..... 181/199; 181/144

[58] Field of Search ..... 181/148, 149, 181/150, 153, 154, 199, 144; D14/207

[56] References Cited

U.S. PATENT DOCUMENTS

| | | | |
|---|---|---|---|
| D. 72,113 | 3/1927 | Ryoinski | D14/207 |
| D. 74,792 | 3/1928 | Himmer | D14/207 |
| D. 138,386 | 7/1944 | Volf | D14/207 |
| D. 251,004 | 2/1979 | Bubash | D14/207 |
| 1,834,741 | 12/1931 | Rigali | 181/199 |
| 3,170,538 | 2/1965 | Detrick . | |
| 3,256,953 | 6/1966 | Rimi . | |
| 4,063,387 | 12/1977 | Mitchell . | |
| 4,640,381 | 2/1987 | Tsuchiya et al. . | |
| 4,754,852 | 7/1988 | Muléet al. . | |
| 4,926,962 | 5/1990 | Graham et al. | 181/150 |
| 5,403,080 | 4/1995 | Thee . | |
| 5,444,194 | 8/1995 | Reinke . | |

FOREIGN PATENT DOCUMENTS

| | | |
|---|---|---|
| 94 06 006 | 9/1994 | Germany . |
| 4422500 | 3/1995 | Germany . |
| 2 164 140 | 3/1986 | United Kingdom . |
| WO 94/12002 | 5/1994 | WIPO . |

OTHER PUBLICATIONS

Charles Henry, "Pillow Telephone", filed Jun. 5, 1923, Serial No. 643,552 (Abstract).

Richard H. Seer. "Combination Radiospeaker and Electric–Light Fixture", filed Feb. 27, 1928, Serial No. 257, 502 (Abstract).

Raymond Cecil Bender, "Acoustic Device", filed Mar. 4, 1930, Serial No. 433,077 (Abstract).

Patent Cooperation Treaty Internation Search Report, international application No. PCT/US 98/03561 mailed Jun. 18, 1998.

*Primary Examiner*—Khanh Dang
*Attorney, Agent, or Firm*—Wolf, Greenfield & Sacks, P.C.

[57] ABSTRACT

A high-fidelity stereophonic or multi-channel speaker system including speakers that mimic architectural columns or corbels. The speakers are enclosed by an acoustically transparent scrim with apertures in the acoustically transparent scrim arranged to simulate stone or wood. Corbel speakers operate in a dipole configuration making them highly suitable for use as satellite speakers in multi-channel systems. In addition, both the column and corbel speakers have an actual secondary utility as display stands; this secondary utility having attendant psychoacoustic effects which enhance the perceived diffusion of the sound from the speakers.

36 Claims, 13 Drawing Sheets

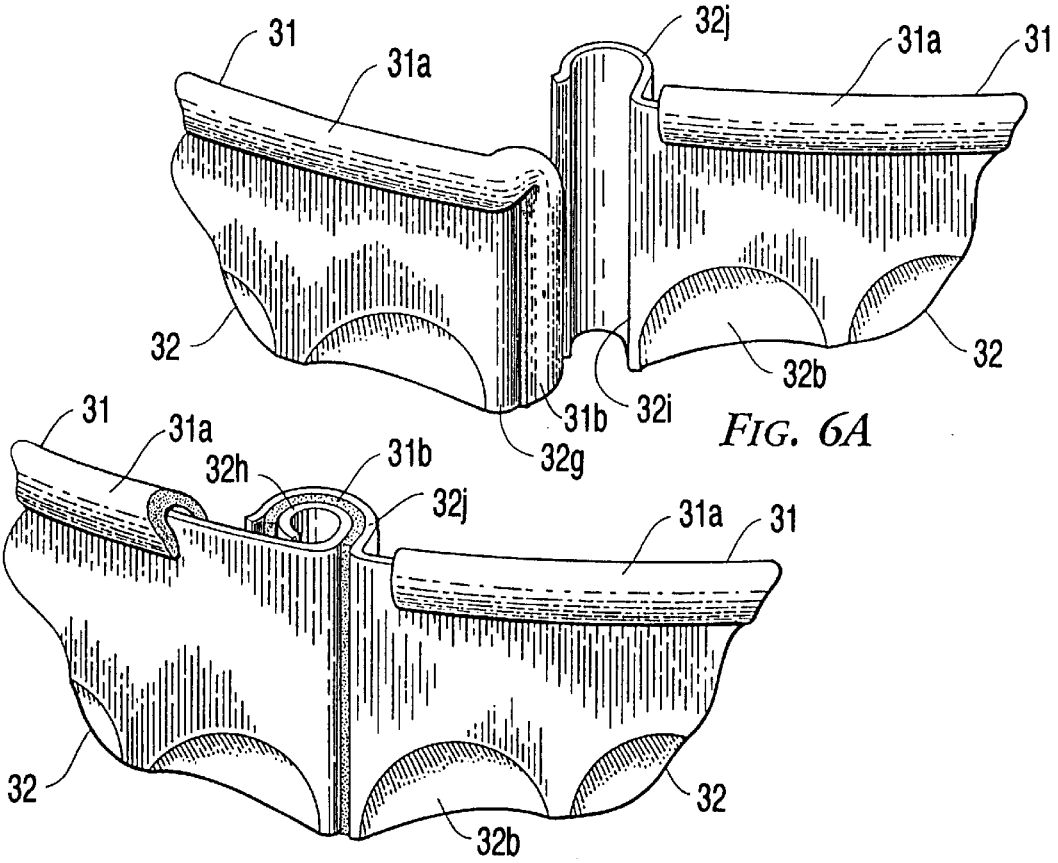
FIG. 6A
FIG. 6B
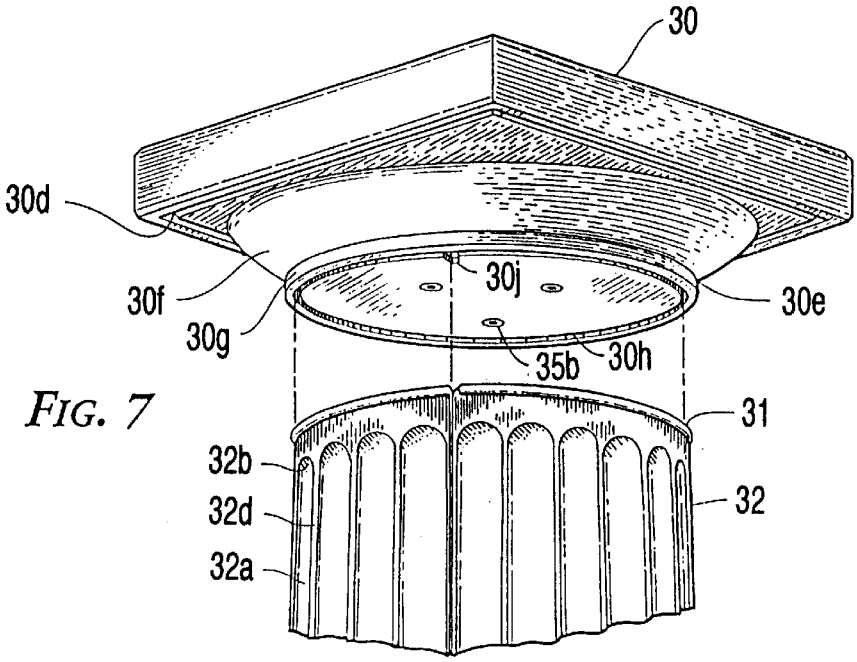
FIG. 7

LOUDSPEAKERS IN ARCHITECTURAL FORM

This application claims priority under 35 U.S.C. §119 (e) to commonly-owned, co-pending U.S. provisional patent application Ser. No. 60/039,099 entitled "Loudspeakers in Architectural Form," filed Feb. 24, 1997, which is incorporated herein by reference in its entirety.

BACKGROUND OF THE INVENTION

1. Field of the Invention

This invention pertains to stereophonic or multi-channel audio reproduction in a high-fidelity audio or audio-visual system, including systems known to those in the trade as "surround sound" and "home theater," and more particularly is directed to loudspeakers in architectural form such as corbels and columns.

2. Discussion of the Related Art

At the introduction of high-fidelity stereophonic audio systems, speaker components were for the first time mounted in discrete enclosures so that they could be widely separated in the interior environment. At that time and ever since, the great preponderance of speaker enclosures have been simple rectangular boxes. A few exceptions to this strict formula do currently exist at the idiosyncratic high-end of the audio market; unconventional acoustical technologies such as electrostatic panels have generated convex shapes which depart from this angular tradition.

Generally, the design of loudspeaker enclosures has been limited to the technical requirements of the housing. When aesthetics have been considered as a factor in the design, the tendency has been to take inspiration from other electronic components. However, when a stereophonic or multi-channel system is installed in a typical interior, the loudspeakers should be widely dispersed in the listening environment to generate any degree of acoustical fidelity. The visual integration of the complete electronic system thus serves little purpose, since the speakers are rarely seen in proximity to other electronic components.

The visual effect of the dispersed sound sources is invariably intrusive in the design setting for the following reasons: a) loudspeakers should be left acoustically exposed, as masking by any object in the environment compromises both the volume and the fidelity of the reproduced sound waves; b) loudspeakers customarily have strict positional requirements, in order to generate a realistic acoustical impression, and should not be placed arbitrarily in the environment; c) sounds are most commonly recorded at or near ear-level, and their faithfulness is therefore compromised when they are reproduced from inconspicuous but counter-intuitive high or low positions; and d) loudspeakers abide by conventions of speaker form and surface design which immediately identify and call attention to the source of sound. This last issue is not only cosmetic; the perceived realism of a sound source depends not only upon the fidelity and dispersion of that source, but upon psychoacoustic perceptions as well. Sound recordings are commonly made from a few points in a diverse acoustical environment. These tracks or channels are then reproduced to an equal number of analogous locations in a listener's environment. Making those sound sources inobvious encourages the interpolation and cognitive blending of these separate acoustical fields, and thereby, without actually altering the detectable acoustics, improves the quality of the listener's aural impression.

The visual intrusion of conventional speakers is especially conspicuous in the case of increasingly popular multi-channel systems, where four to six sources are commonly required to attain the prescribed dimensional effect. Since ideal acoustical locations invariably correlate with the eye-level of the listener, these multiple loudspeaker enclosures are unavoidably located within the immediate visual field of the audience. Furthermore, the prevailing method for bringing these loudspeakers to ear-level is to mount them on expressly devised black tubular-steel frames. This convention imparts additional costs and further inhibits the speakers' visual integration into an interior.

A body of related art concerns itself with the installation of loudspeakers in walls and ceilings. Since this process is inconvenient, costly, immobile, and technically limited, various other proposals have been made for concealing sources of reproduced sound. For example, a variety of household objects have been adapted to such concealment, including vases, planters, flower pots, books and lamps. In each case, the sound source is disguised by giving it a real or apparent secondary utility. For example, Reinke, in U.S. Pat. No. 5,444,184 discloses a speaker enclosure in the form of a vase. The aesthetic effectiveness of Reinke's design is limited by the large openings in the sides of the object, and by the placement of a lid on the top of the vase. These visual details are uncommon elements in a real decorative vase and work against its perceptibility as a decorative object. Furthermore, the device has no actual utility as a vase or container, since the interior of the vase is occupied by the loudspeaker elements. Thee, in U.S. Pat. No. 5,403,080, discloses a device for the concealment of a loudspeaker. The device includes a fabric screen covering front and side walls made of plastic or wood. Likewise, Mitchell, in U.S. Pat. No. 4,063,387, discloses a hanging plant pot speaker. Mitchell describes a system in which a downward-thrusting speaker that is located in a ceramic pot projects sound through a hole in the bottom of the enclosure and is deflected radially by a diffuser plate located beneath the speaker.

SUMMARY OF THE INVENTION

The present invention provides loudspeakers in architectural form to reproduce high-fidelity sound from a concealed source commonly encountered in interior environments, thereby contributing to a perceived diffusion of the sound source. The architectural forms or furniture elements are readily adaptable to a variety of speaker configurations known to those in the trade, including bipole, dipole, tripole, polygonal, and pyramidal arrangements in radiant or reflecting modes. In addition, a secondary utility of the architectural or furniture elements is selected so that their natural functional location in the interior environment coincides with optimal acoustic placement.

According to embodiments of the present invention, an enclosure for an audio speaker includes a plurality of surfaces surrounding at least a portion of the speaker. The plurality of surfaces have a first surface design and contour that collectively mimic a second design and contour of at least a portion of a load-bearing structural support member to psycho-acoustically conceal the speaker when the speaker projects sound. Furthermore, because the enclosure provides structural support for a load in a manner that is analogous to the load-bearing structural support member, psycho-acoustic concealment is further enhanced. As used herein, the term "psycho-acoustic concealment" is used to mean visually concealing a source of sound in a manner that deceives one's cognitive capabilities to aurally locate the source of sound, thereby enhancing the perceived diffusion of the source of sound. In various embodiments of the present invention, the surface design and contour of the plurality of surfaces mimic an architectural corbel, or architectural column. The outwardly visible shape and form of the enclosure and the enclosure's actual secondary utility as a structural support member mimic that of commonly known architectural support members to psycho-acoustically conceal the speaker and enhance the aural perception of sound.

In one embodiment of the invention, an audio speaker includes at least one speaker element capable of producing acoustical energy from an electrical audio source signal, a substantially hollow elongate enclosure to support the speaker element, and a capital relief element coupled to a first end of the enclosure and a base relief element coupled to a second end of the enclosure, the capital and base relief elements forming at least a fraction of an architectural column. In another embodiment, an audio speaker includes at least one speaker element capable of producing acoustical energy from an electrical audio source signal, a substantially hollow enclosure to support the at least one speaker element, the enclosure including first and second planar surfaces that are parallel to each other, a third planar surface that is perpendicular to and abuts the first and second surfaces, a fourth planar surface that is perpendicular to and abuts each of the first, second and third planar surfaces, and a fifth surface abutting the first, second, third and fourth surfaces to form the enclosure. An exterior face of the fifth surface includes relief elements, and the enclosure forms a corbel.

According to another embodiment of the present invention, an enclosure for concealing at least one speaker element of an audio speaker includes a visually opaque scrim that covers a portion of the audio speaker that includes the at least one speaker element. The scrim has a plurality of apertures formed therethrough, a density of the plurality of apertures being greater in regions of the scrim that are in front of the at least one speaker element than in regions of the scrim that are not in front of the at least one speaker element. The plurality of apertures are constructed and arranged to form a bitonal image. In this embodiment, the bitonal image formed by the plurality of apertures conceal the speaker elements from view to enhance aural perception of sound. In one preferred embodiment, the plurality of apertures are constructed and arranged to form a bitonal image of a pattern that occurs in nature, for example, that of stone or wood.

According to a further embodiment of the present invention, a method of concealing an audio speaker includes forming a speaker enclosure having an outwardly visible shape that suggests an object other than a rectangularly shaped audio speaker, operatively mounting the at least one speaker in the speaker enclosure, selecting a pattern that is characteristically associated with an outward appearance of the object, perforating a visually opaque sheet of material to form a bitonal image of the pattern in the sheet of material, and covering the at least one speaker element with the perforated sheet of material.

BRIEF DESCRIPTION OF THE DRAWINGS

Preferred, non-limiting embodiments of the present invention will be described by way of example with reference to the accompanying drawings, in which:

FIG. 6A is a detail view of the column shaft showing installation of an anti-vibration gasket;

FIG. 6B is a detail view of the closed column shaft seam, with a portion of the top segment of the anti-vibration gasket cut away;

FIG. 7 is a perspective view of the underside of a column capital;

DETAILED DESCRIPTION

Figure 1A:
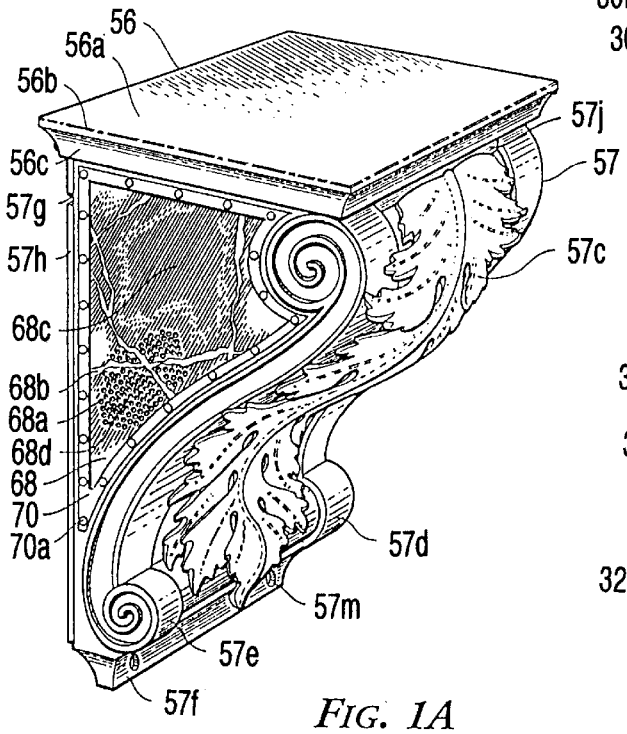
FIG. 1A is a perspective view of a device in the form of an architectural corbel in accordance with an embodiment of the present invention.
Figure 1B:
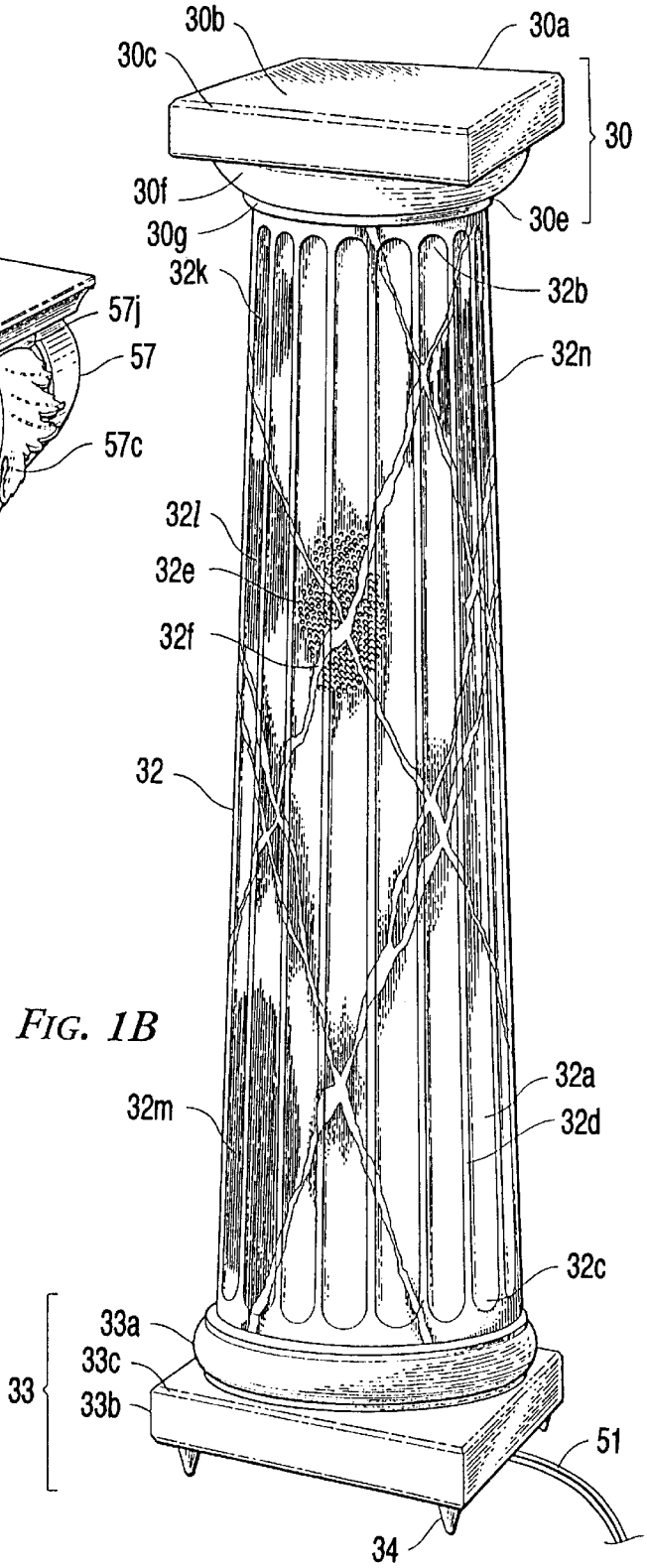
FIG. 1B is a perspective view of a device in the form of an architectural column in accordance with another embodiment of the present invention.
Figure 2:
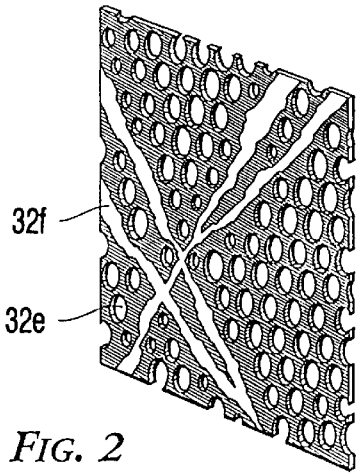
FIG. 2 is a schematic detail of the perforated simulated-marble scrim of the speakers shown in FIGS. 1A and 1B.

The present invention is directed to loudspeakers in architectural form. The loudspeakers reproduce high-fidelity sound from a concealed source commonly encountered in interior environments and contribute to a perceived diffusion of the sound source. FIGS. 1A, 1B, and 2 illustrate outward aspects of embodiments of the loudspeakers in architectural form of the present invention. FIGS. 1A and 1B represent two component types whose structure and operation are described in detail herein, and FIG. 2 shows a detail of the speakers' perforated, simulated-marble scrim.

FIG. 1A shows a first of these component types, a loudspeaker in the form of an architectural corbel. The corbel-shaped loudspeaker includes rectangular shelf 56 and molded housing 57. Rectangular shelf 56 includes planar display surface 56*a*, chamfering 56*b*, and, on the three sides of the rectangular shelf exposed to view, concave perimeter moulding 56*c*. Molded housing 57 is formed with ornamental reliefs including longitudinal centrally-aligned acanthus leaf 57*c*, flanking right and left scrolls or volutes 57*d*, 57*e* and concave base moulding 57*f*. Concave base moulding 57*f* is perforated by two security screw-holes 57*m*. Vertical channels or reveals 57*h* are located along the back edges of the molded housing 57. Horizontal wire-channel 57*g* crosses the back of housing 57 and opens, on the right and left sides, into vertical reveal 57*h*. Preferably, the corbel-shaped loudspeaker is a dipole-type loudspeaker. A dipole loudspeaker typically has two arrays of loudspeakers firing outwardly in opposite directions to create a horizontally-diffused acoustical field. These right and left arrays are generally acoustically similar.

Figure 8:
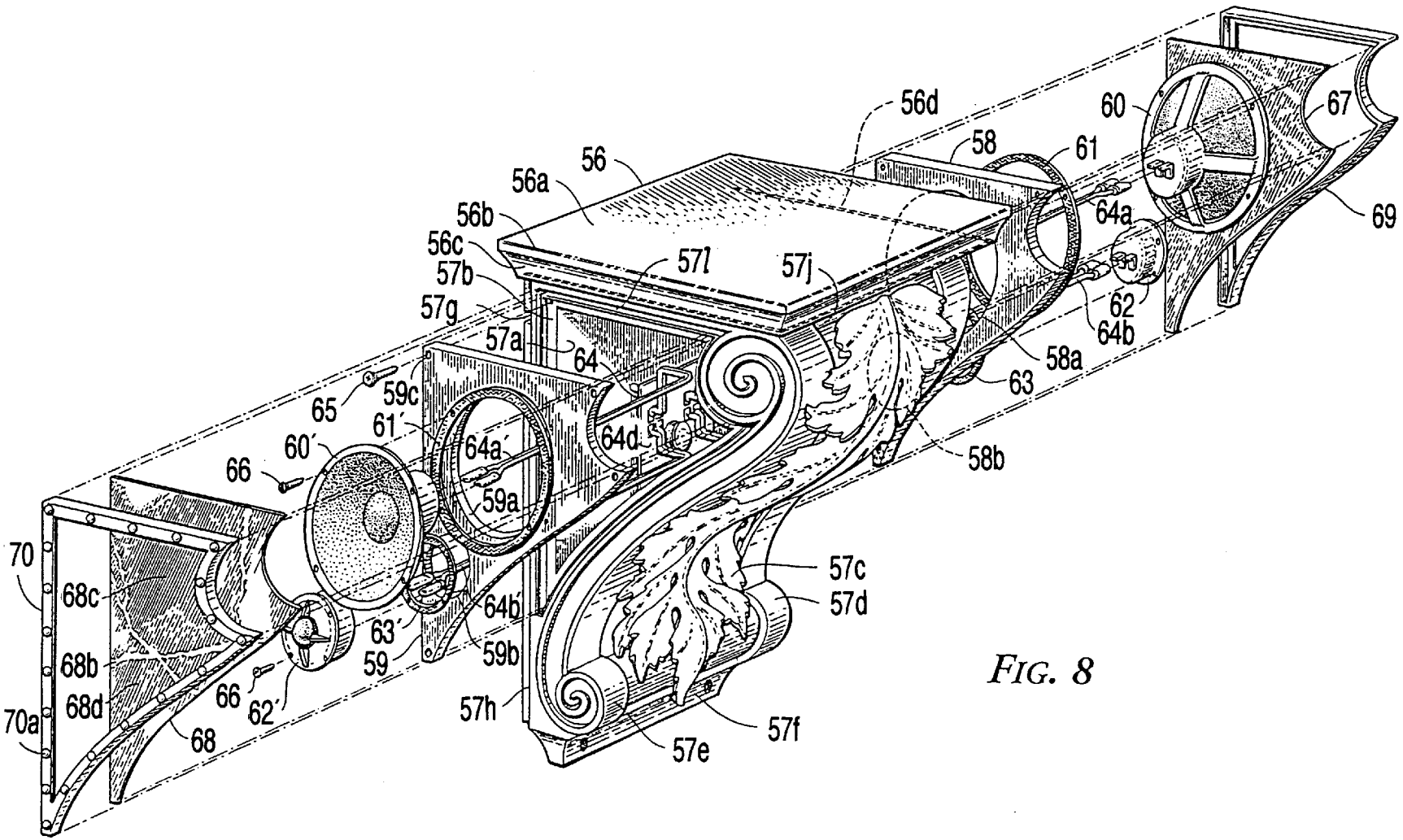
FIG. 8 is a partially exploded view of the corbel speaker shown in FIG. 1A.

An acoustically transparent perforated metal scrim 68 conceals left midrange speaker 60' and left tweeter 62' (as shown in the exploded view of FIG. 8). The perforated metal scrim includes a multiplicity of apertures 68*a* of differing size. The apertures appear darker than the remaining scrim material, and are varied and arranged in a manner analogous to a dot screen of a monochrome image of veined marble. Areas of the scrim surface are left intact and unperforated in a pattern that simulates the characteristic veining of marble. The remaining surface of metal scrim 68 is decorated with printed veining 68*b* varied in color or contrast to reinforce the visual simulation of marble. The pattern of apertures is conscientiously arranged so that areas of high acoustical transparency 68*c*, 68*d* correspond with the location of the hidden midrange and tweeter, respectively. An equivalent arrangement is obtained on the opposite side. The functional characteristics of the corbel speaker will be detailed hereinafter in reference to FIGS. 8 to 11 inclusive; further attributes of the corbel speaker will be better understood after the immediately following description of the structure, fabrication, and assembly of the column speaker.

Figure 5:
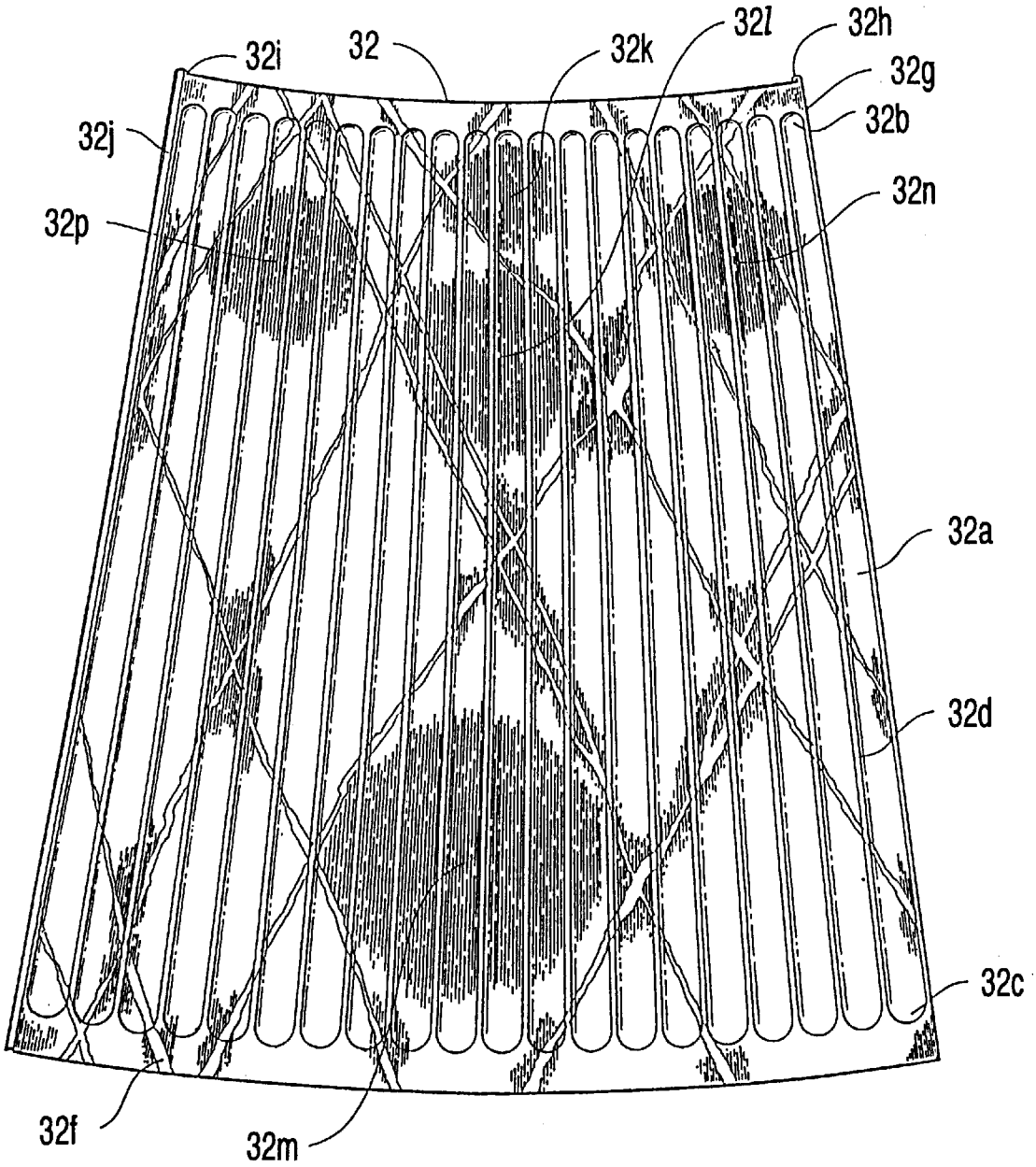
FIG. 5 is a front view of column scrim sheet material after perforation, profiling, printing, rolling, and folding.

FIG. 1B shows the second of the two component types, a loudspeaker having visible external elements which collectively convey the impression of an architectural column. To this end there is provided capital 30, having square, flat, superior platform or abacus 30*a*. The abacus includes flat surface 30*b* suitable for display, and chamfering 30*c*. Circumferential ornamented or moulded area 30*e* is disposed beneath this abacus; in one embodiment this circumferential moulding is represented by an echinus characteristic of the Classical Greek Doric architectural order. Circumferential moulding 30*e* would commonly include discontinuous geometric surfaces, manifested presently by cushion-shaped echinus body 30*f* and cylindrical extension 30*g*. The entire capital is typically formed monolithically of cast or machined medium-density fiberboard (MDF). The speaker elements are concealed and wholly enclosed by acoustically transparent columnar scrim 32. Metal, having been perforated and printed in the manner previously outlined for the corbel scrims, is rolled into a tapered sleeve or elongate truncated cone. The overall taper of the sleeve is typically between 1° and 3°. This essentially cylindrical shape is embossed or incused with a plurality of elongate, radially repeated concavities 32*a*, having the appearance of traditional column fluting. Each flute ends just short of the edges of the scrim in upper terminus 32*b* and lower terminus 32*c*, each having the approximate shape of the concave surface of a quartered sphere. Formation of concave flutes 32*a* leaves narrow flats or arises 32*d* in the intervening surface. Zones of high acoustical transparency 32*k*, 32*l*, 32*m*, 32*n*, and 32*p*, are partially visible in FIG. 1B and FIG. 3, but are best explained in the subsequent description of the scrim fabrication process; the five zones are illustrated comprehensively in FIG. 5. The cylindrical scrim surmounts base 33 formed of the same material as capital 30. This base includes convex circumferential moulding or torus 33*a* and square, flat, base platform, or plinth 33*b*. The edges of the plinth are relieved with chamfering 33*c*. The underside of the plinth is fitted with carpet-penetrating conical feet 34. Speaker-wire 51 for the column speaker is fed through the open space under the plinth and between the feet.

FIG. 2 shows a detailed view of a square sample of the perforated scrim material. Apertures 32*e* of varied size and spacing provide acoustical transparency and convey a low-resolution image of veined marble. Calibration of the perforation pattern and the printed imagery allows veining 32*f* to be printed in an uninterrupted fashion on the remaining material, further enhancing the visual impression of veined marble. The deliberate arrangement of these patterns allows a high degree of optical opacity and obstruction to be obtained. Although apertures 32*e* are depicted in FIG. 2 as having a circular shape, they may also have a non-circular shape, for example a polygonal shape, as known to one of ordinary skill in the art. Preferably, apertures 32*e* have an irregular shape that varies somewhat randomly from aperture to aperture, and which, together with the varied spacing of the apertures, reduces undesirable moire effects due to spatially repetitive patterns. Further details of the design and manufacture of this scrim material are described more fully below, after the following description of the column speaker's internal elements.

Figure 3:
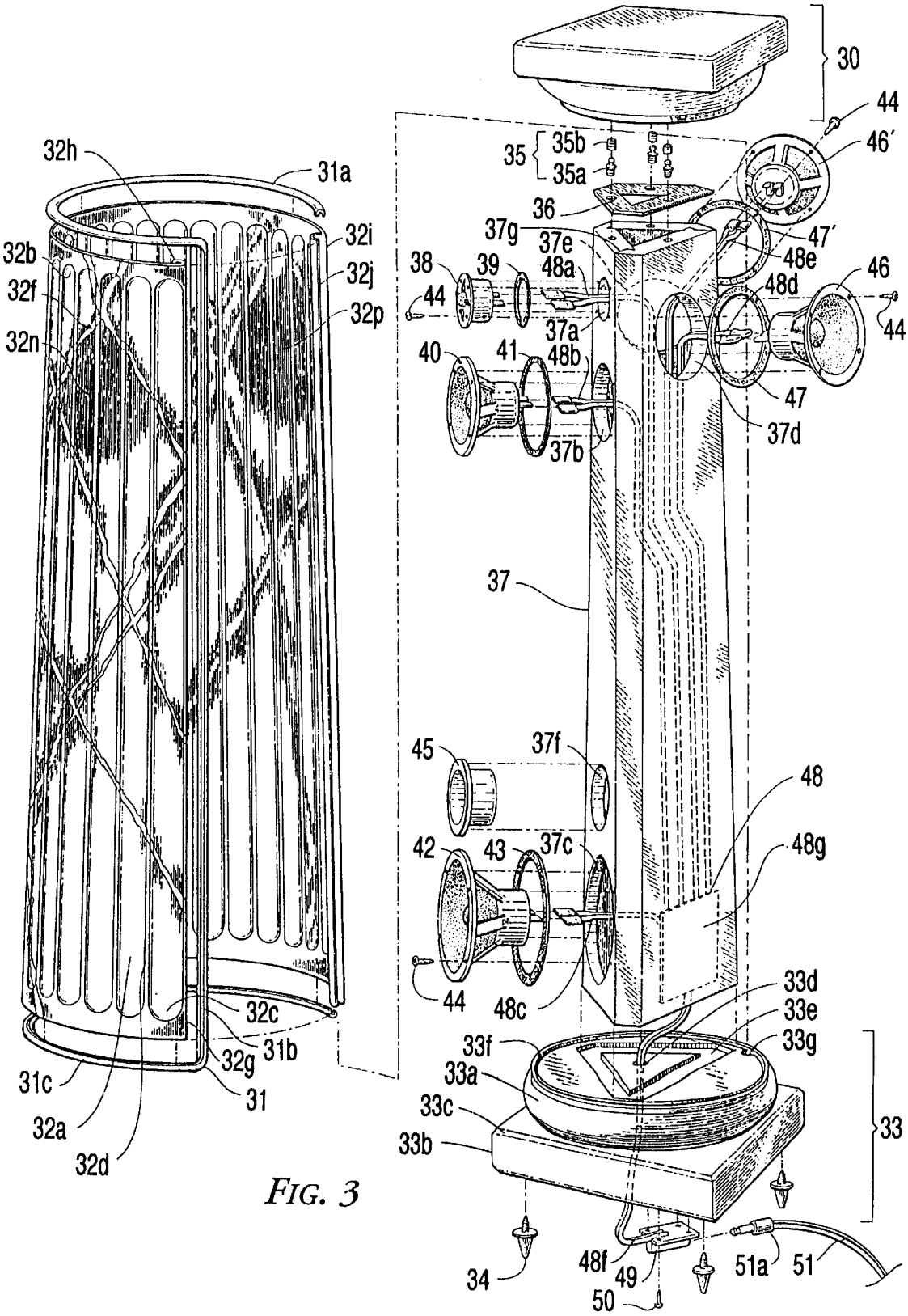
FIG. 3 is an exploded view of the column speaker shown in FIG. 1B.

Concealed internal components of the column speaker shown in FIG. 1A are shown in an exploded view in FIG. 3. Speaker housing 37 is typically assembled from three panels, or baffles, cut from 19 mm (¾") thick MDF sheet material. Tapered parts may be laid out alternately on the MDF sheet stock to minimize cutting and waste. The long seams of the speaker housing are profiled with matching "bird's-mouth" type locking-joints 37*g*, which limit movement during glue-up and assembly. A transverse section of the housing may be described as a truncated triangle or as an irregular but radially symmetrical hexagon. The housing has a slight taper, being wider at the bottom than at the top, which corresponds to the taper of the columnar scrim. The interior of the housing is hollow, and serves as an acoustically resonant chamber. Its triangular and tapered form prevents undesirable "box-boom" standing-wave resonances that commonly occur in housings having parallel plane faces.

In FIG. 3, the capital is shown separated from the speaker housing. The capital and the speaker housing are connected by pin-and-socket type repeated-use fasteners 35. Male fasteners 35*a* are installed in the top end of the column speaker housing, and female fasteners 35*b* in corresponding locations in capital 30. Vibration-damping gasket 36 in the shape of an open triangle substantially covers the top end of speaker housing 37. Gaskets in all embodiments serve as a vibration-damping means, and may be formed of silicone rubber, SORBOTHANE® material, or a similar resilient material. The bottom of the speaker housing is retained in recess or dado 33*e* in column speaker base 33 and may be fixed permanently with a suitable vibration-damping adhesive, preferably meeting ASTM spec. C-834-7C, such as DAP® Alex™ plus material (acrylic latex plus silicone). The speaker configuration of the columnar speaker may be described as a tripole direct/reflecting loudspeaker. Two of the speaker's faces bear similar wide-range speaker elements 46, 46' which are designed to be operated in reflection, and a third face carries an acoustically distinct array of speaker elements 38, 40, 42 which are optimized for conventional direct or radiant operation. This front or radiant face includes openings 37*a*, 37*b*, 37*c* formed to accept tweeter 38, mid-range 40, and woofer 42, respectively. Vibration-damping speaker gaskets 39, 41, 43 are seated around the rim of respective openings 37*a*, 37*b*, 37*c*. Corbel crossover assembly 48 includes speaker leads 48*a*–48*e* inclusive, jumper wire 48*f* from the signal source, and column speaker crossover circuit-board 48*g*. Speaker elements 38, 40, 42 are connected by leads 48*a*, 48*b*, 48*c* respectively to column speaker crossover circuit-board 48*g* and are secured to the housing with speaker-retaining screws 44. The front face also includes opening or port 37*f*. The port is fitted with peripheral vent port bezel 45. The bezel is formed to minimize wind noise and maximize air flow, and furthermore to prevent deterioration of the MDF and improve appearance. The right and left reflecting speakers 46, 46' are typically devised so as to reproduce a wide range of acoustical wavelengths. These speakers are fitted with respective gaskets 47, 47', connected to appropriate leads 48*d*, 48*e*, and installed in housing openings 37*d*, 37*e*, respectively. Jumper-wire 48*f* from the crossover board is fed through hole 33*d* in column base 33. The jumper-wire is connected to column speaker jack 49. The jack is fixed to the underside of column base 33 with speaker jack mounting screws 50. Connection between speaker-wire plug 51*a* and jack 49 can thereby be made in a concealed fashion. The bottom rim of the assembled columnar scrim is received by scrim-retaining groove 33*f*, and radially located by bottom scrim-alignment hole 33*g*. The manner of installation of acoustically transparent scrim 32 will become evident in the following description of the method of its manufacture and assembly.

Figure 4A:
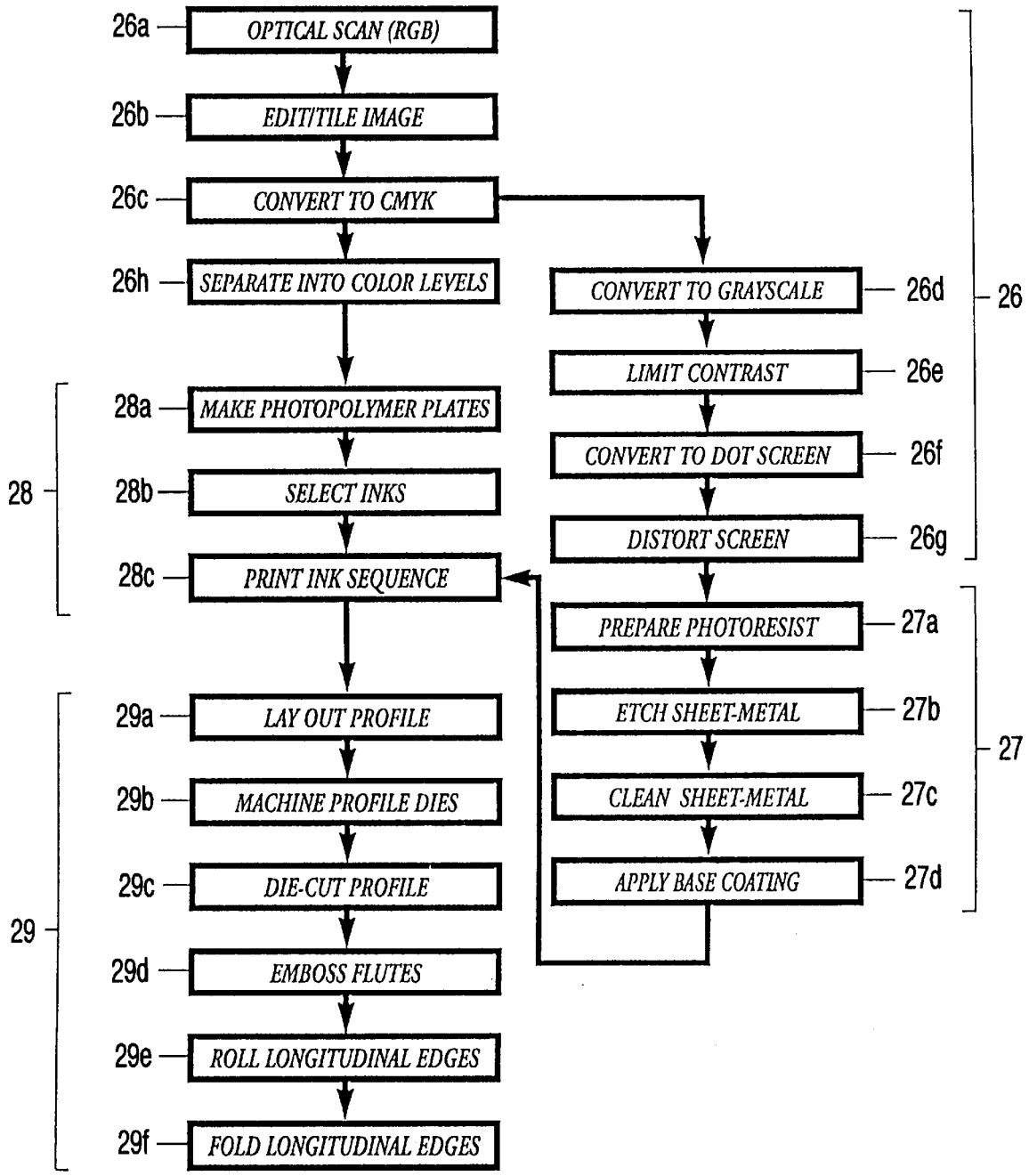
FIG. 4A is a flow chart describing a method of manufacture for the marbleized, acoustically transparent columnar scrim.
Figure 4B:
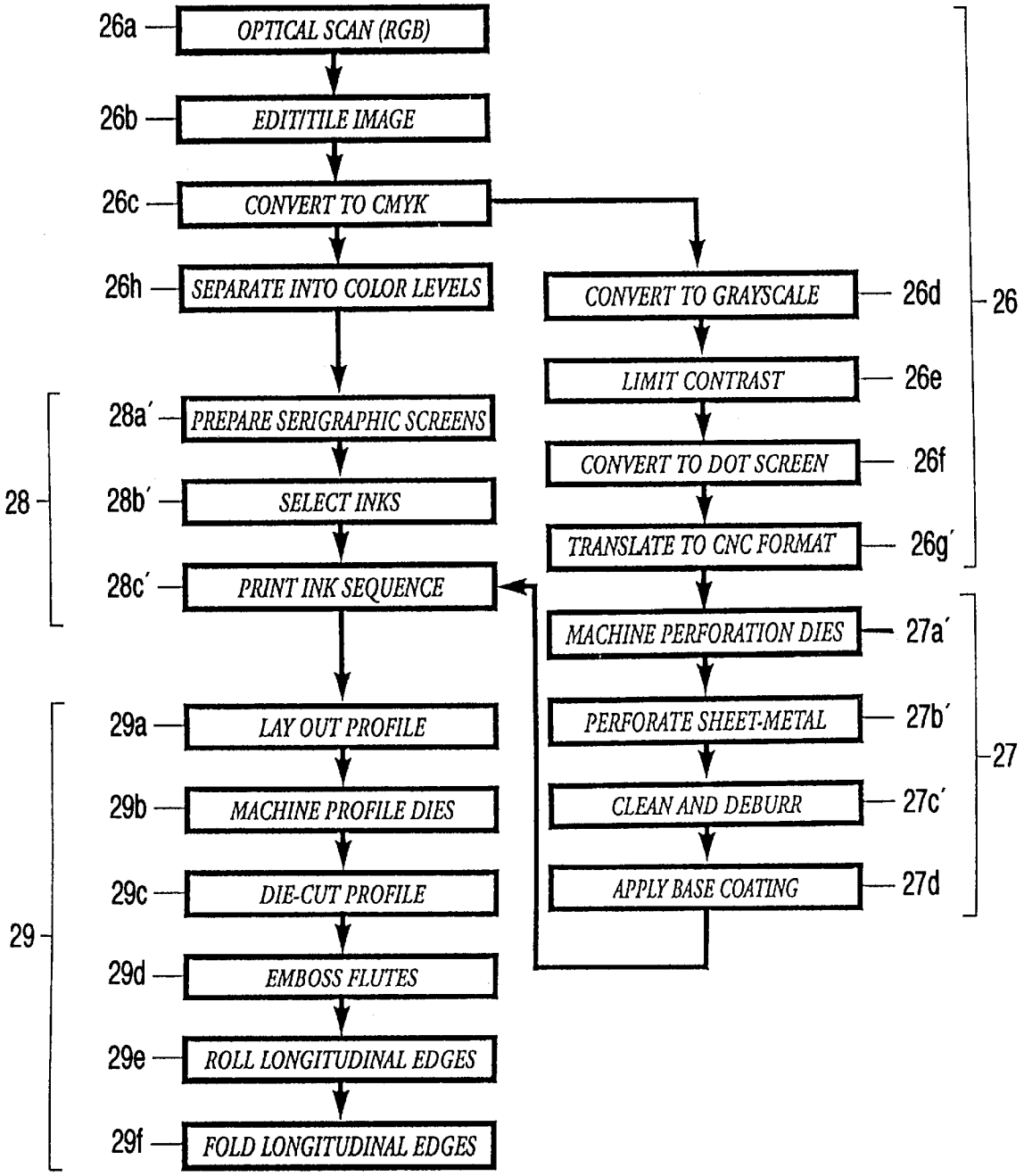
FIG. 4B is a flow chart describing a method of manufacture for the marbleized, acoustically transparent columnar scrim.
Figure 4C:
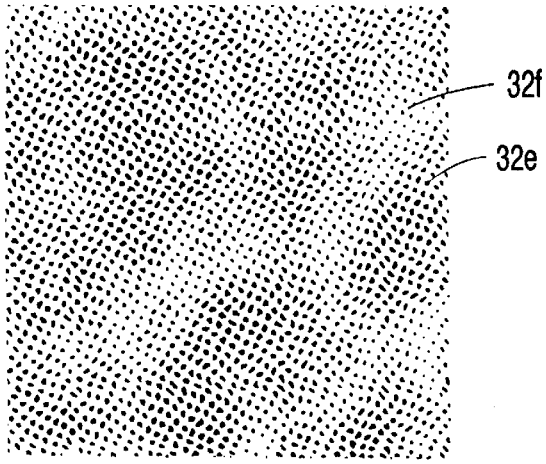
FIG. 4C is distorted non-periodic dot screen aperture pattern derived from an image of veined marble.
Figure 4D:
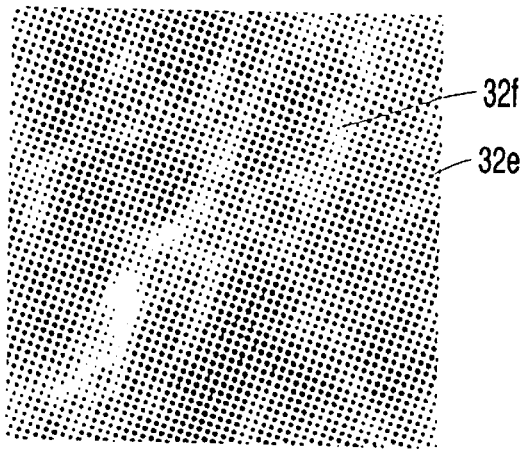
FIG. 4D is a periodic dot screen aperture pattern derived from an image of veined marble.

FIGS. 4A–E, and 5 refer to the manufacture of the simulated marble scrim. More specifically, FIG. 4A is a flow chart describing a process for the fabrication of column scrim 32 using photo-lithographic etching techniques, while FIG. 4B is a flow chart describing a process for the fabrication of column scrim 32 using mechanically machined perforation dies. Those steps that are common to both processes are described with respect to FIG. 4A, while differences are separately noted. FIGS. 4C and 4D depict representative dot screens that can be used as a template to produce apertures in the metal scrim according to the processes of FIGS. 4A and 4B, respectively. However, some details of the structure of the scrim are best seen in reference to FIGS. 6A to 7, which illustrate various steps in the assembly of the acoustically transparent columnar scrim.

As depicted in both FIGS. 4A and 4B, the independent steps in the fabrication of the scrim can be divided into four phases: image processing 26, perforation 27, printing 28, and forming 29. An initial step in each process is to obtain an image having the visual aspect of marble. Commonly this can be achieved by optically scanning 26*a* either a photograph or an actual marble sheet or tile. This typically results in a three-channel, red-green-blue (RGB) digital color image file, which may then be read by a computer, output to a CRT monitor and edited in step 26*b*. At step 26*b* the digital color image file is edited in a pixel-based or object-based image-editing application so that edges of the image "tile," i.e., are continuous across seams. This tiling may involve a single image or multiple copies thereof. Most of the processes described herein are digital; these digital processes commonly have analogous mechanical antecedents which are familiar to those practiced in the art. These mechanical processes may be substituted for their digital equivalents without affecting the essence of the process. A description of a typical digital editing sequence follows, although other editing sequences could alternatively be used.

The base color of a piece of natural marble is typically traversed by an irregular lattice of veins of a contrasting color. In nature, these veins may be lighter or darker than the base color. The human eye is naturally first drawn to the highlights in an image, and therefore, conversely, diverted from the visibly darker areas. It is desirable that the apertures in the completed scrim be visually avoided in order to convey the best simulation of the natural material. Furthermore, it is advantageous in the assembled speaker that the contrast between the shadowed areas behind the scrim seen through the apertures and the predominant color of the simulated marble be minimized; darker colors better blend with these shaded apertures. Accordingly, in preferred embodiments of the present invention, an ideal marble pattern includes lighter veins on a relatively darker background. If the original scanned marble image is light-veined, it may be readily inverted, i.e. made "negative," in an image-editing application. Speaker locations and seams are anticipated and the marble image is edited or modified so that the light veins will skirt the speakers and will be continuous across the column's longitudinal seam. Areas of the image over the eventual locations of the speakers are darkened. These dark areas will subsequently be translated into zones of high acoustical transparency. This layout at this point in the process may be understood in reference to the completed scrim in FIG. 5, where high-transparency areas 32*k*, 32*l*, 32*m*, 32*n*, and 32*p*, correspond respectively to tweeter 38, midrange 40, woofer 42, right reflector 46, and left reflector 46' (as shown in FIG. 3). The high-transparency areas are conspicuously delineated in the illustrations for the sake of clarity. When the layout of the image is complete, the RGB marble image is further adjusted for hue, brightness, and contrast as desired. Once these adjustments of the RGB file are finished, a copy is made and converted at step 26*c* to a four-channel, cyan-magenta-yellow-black, or CMYK, mode. A copy of the CMYK image is converted to a monochrome, grayscale mode in step 26*d* and saved as a separate image file.

At step 26*e* the contrast of the grayscale or monochrome image is limited and adjusted. Sheet metal of a given thickness and alloy will have a maximum percentage of its surface area that may be removed by perforation before it loses its structural integrity. The maximum density level, or "black," of the monochrome image is therefore preferably set at or just below that percentage. For example, if the most metal that may be removed is 60%, then the darkest zones of the monochrome image, typically those to be located in front of the speaker elements, are defined as a 60% gray, i.e. a gray composed of 60% black and 40% white. The "white" level is then set, preferably at a threshold which will leave the veined areas 100% white. Once these parameters are set, the gray levels of the intermediate areas can be independently adjusted and edited to improve appearance, or to guarantee a specific, local degree of average or median transparency. This grayscale image is then digitally converted at step 26*f* to a dot screen. Some image-editing applications offer two screen output modes; a first for actual printing screens, and a second for the graphic simulation of such dot screens. The latter type of screen output typically retains more useful information on each given dot shape and is therefore preferred.

The dot screen is then distorted at step 26*g* to diminish the visual regularity of the apertures or holes. Regular hole patterns can confuse binocular vision and can create undesirable moire effects between the foremost surface and either cast shadows or secondary perforated surfaces. The defining grid of the dot screen is therefore locally displaced to create a more arbitrary pattern. Preferably the dot shapes themselves are also varied somewhat randomly by the distorting process, while substantially maintaining the area of the individual holes and their associated bar widths. The collective effect of these distortions makes the hole pattern more naturalistic and more visually restful. A representative example of the resulting distorted dot screen pattern is illustrated in FIG. 4C.

The distorted dot screen pattern from step 26*g* would then typically be output from the digital source file onto a substantially transparent sheet material, such as acetate or MYLAR, for example. From this image on the sheet material a photosensitive resist is prepared on one or more surfaces of a piece of sheet-metal of appropriate size and thickness at step 27*a*. At step 27*b* the sheet-metal is etched for a period of time sufficient to generate holes in the sheet-metal. When the desired degree of perforation is attained, etching is arrested in a conventional manner. The result of this etching process is that a low-resolution image of the marble pattern is rendered by the apertures alone. The sheet metal is then cleaned of the remaining resist and any other residual debris at step 27*c*.

In contrast to the process of FIG. 4A, the process of FIG. 4B does not include a step of distorting the dot screen. In general, this difference is attributable to the difficulty and expense of creating sheet-metal cutting dies where the cut-outs differ in both shape and size from each other. Accordingly, in the process of FIG. 4B, the digitally converted dot screen pattern is translated at step 26*g*' from a pixel-based rasterized format to a geometrical, typically vector-based or object-based CNC-readable file format, and used as a source file at step 27*a*' for the automated machining of sheet-metal cutting-dies. Sheet-metal blanks slightly larger than the final column scrim pattern are then perforated at step 27*b*' using these dies, with the result that a low-resolution image of the marble pattern is once again rendered by the apertures alone. A representative example of the resulting pattern is shown in FIG. 4D. After perforating the sheet-metal at step 27*b*', the perforated metal is then cleaned and deburred at step 27*c*'.

After either of step 27*c* or step 27*c*', the perforated metal is provided with a base coating of pigmented material of intermediate color by an immersive, aerosol or electrostatic process at step 27*d*. The electrostatic process is generally preferred, as surface tension in an immersive process and turbulence in aerosol application can prevent the sidewalls of the apertures from being thoroughly coated. The intermediate color of the coating can be decided upon by various means: first, objectively; second, in anticipation and consideration of the final printed colors; third, by numerically averaging a digitized image file; or, fourth, by blurring and sampling a digital color image. Other possibilities will be readily apparent to those skilled in the art.

After step 27*d* of either process, the edited color image file is accessed again, this time as a source for more detailed ornamentation. The CMYK file may be printed on the scrim in a modified four-color process, using the cyan, magenta, and yellow separation channels in a traditional fashion, but substituting the apertures for the black. More typically, the color file is separated at step 26*h* into an elective number of color levels, based on either chromatic or tonal data from the source image.

In the photo-lithographic based process of FIG. 4A, the separated color level files are converted at step 28*a* into a series of resilient printing plates that are commonly termed flexographic printing plates. Flexographic printing plates are typically composed of photopolymers which shrink in areas that are exposed to actinic light to produce an offset image surface. The preparation of such flexographic printing plates is known to those practiced in the art. If the resilient plate material is selected to be of an appropriate durometer, and the plate appropriately mounted and operated by one of ordinary skill in the art, patterns may readily be printed on the perforated material with a minimal incursion of ink into the openings.

After preparing the flexographic plates at step 28*a*, a customized palette of inks is selected at step 28*b* to best represent the desired graphic pattern. The same plates may be used for differing color effects, as only the inks would need to be changed. Since the perforated material will typically be viewed against a dark and shadowed surface, the pattern of perforation may, for practical purposes, be treated as a black channel. This channel may be superimposed on a pixel-based or object-based image during editing to better anticipate the eventual visual impression. Because the metal undergoes further forming, and because the speaker scrim will encounter a certain degree of wear in its end-use, flexible abrasion-resistant inks expressly formulated for such uses are recommended. It should be apparent that because the pattern of perforation and the printing plates are derived from the same edited image file, the patterns can be readily aligned and printed at step 28*c*. The registered perforated and printed patterns combine to convey a highly realistic, marble-like effect. It should be understood that in practice, the scanned image will typically include multiple levels of tone and color, rather than the two simple levels suggested by the schematic illustration in FIG. 2.

An alternate method of printing an image pattern on the perforated scrim is depicted in FIG. 4B. Although this alternate method of printing is described with respect to FIG. 4B, it can also be used with the photo-lithographically produced scrim of FIG. 4A, as could other types of printing processes. In the printing process of FIG. 4B, after separating the color file into an elective number of color levels at step 26*h*, the separated color level files are converted photographically to a series of serigraphic partially-masked screens at step 28*a*'. After the serigraphic screens are prepared, a customized palette of inks is selected at step 28*b*' to best represent the desired graphic pattern. As in the flexographic printing process described above, the same screens can be used for differing color effects by changing the inks that are used. Furthermore, as in the flexographic printing process described above, flexible abrasion-resistant inks expressly formulated for use on the particular type of scrim material are recommended. After selecting the inks at step 28*b*', the pattern of perforation and the serigraphic screens are aligned and printed at step 28*c*'.

After the scrim is printed in either of steps 28*c* or 28*c*', perforated and printed sheets intended for the corbel speakers would be set aside for final cutting to profile. The column speaker scrims, however, undergo additional processes of embossing, rolling, and folding. For the column speaker scrims a pattern is laid out at step 29*a* for the profile of the column scrim blanks. The pattern essentially constitutes a flat mapping of the scrim's final form as a tapered cylinder. This flat tapered shape includes a shallow concave arc at the top, and a second shallow convex arc, concentric with the first, at the bottom. Straight edges connect the two arcs. The pattern is derived so that when the straight edges are abutted in a way that makes their large surfaces substantially tangent at the seam, a tapered columnar shape self-forms. Furthermore, the radii of the top and bottom edges are selected so that when the straight edges are abutted in the aforementioned manner, and the curvature of the surface given maximum constancy, the top and bottom edges self-form into circles occupying parallel planes. Allowances are added for the formation of the folds and rolled edges, and for any anticipated contraction of the material during the embossment of the flutes. Cutting-dies are machined at step 29*b* based on this pattern, and the flat, perforated, printed metal blanks are cut to this profile at step 29*c*.

After the printed metal blanks are cut to profile at step 29*c*, mating molds are prepared with a gap substantially equal to the thickness of the sheet material, and having in relief the positive and negative topology of the alternating flutes and arrises. According to the traditions of Classical architecture, these should number between sixteen and twenty. In the molds, these flutes and arrises are arranged so that their long axes are regularly spaced in a radial pattern. The flat arrises are traditionally constant in width, whereas the flutes are tapered to accommodate the changing diameter of the tapered column. A flat band is left along the straight edges to allow for the subsequent formation of the rolled seam elements. A profiled, perforated, printed metal blank is then fed between the separated molds, and the molds are brought into proximity with sufficient force that the fluted topology is permanently embossed into the metal sheet at step 29*d*.

Seam closure elements 32*h*, 32*j* (shown in FIGS. 6A and 6B) are then rolled at step 29*e*; smaller inner bead 32*h* is rolled to a closed cylindrical shape, and the larger outer retaining clasp 32*j* is rolled to a cylindrical section of about 215°. The rolled outer clasp is given a slight reflex or return which eases the insertion of the inner bead. An allowance is left between the respective radii for the vibration-damping columnar scrim gasket. Bends 32*g*, 32*i* parallel and adjacent to the rolled seam elements are then created at step 29*f* by folding the sheet metal, including the rolled elements, orthogonally to the flattened column, whereby the rolled edges are displaced toward the eventual interior of the column scrim, thus completing the formation of the perforated columnar scrim.

The attributes of the scrim seam may be further understood in reference to FIGS. 6A and 6B, which illustrate the assembly of the scrim into its columnar form. FIG. 6A is a view of the open column seam, and FIG. 6B is a view of the closed column seam in which a portion of the gasket has been cut away. Column scrim gasket 31 is typically formed of slit elastic silicone rubber tubing, which is slipped, prior to the closure of the seam, over the edges of the scrim. This is done in three distinct segments: top segment 31*a* is slipped over the plain top rim of the column scrim, middle longitudinal seam segment 31*b* over the rolled interior component of the seam, and bottom segment 31*c* around the circumference of the bottom edge. The seam is then closed and held in place by spring tension in the rolled outer clasp and by the resiliency of the gasket material.

FIG. 7 shows the location of drip-stop 30*d* and the method of installation of the assembled columnar scrim. This view of the underside of column capital 30 shows the location of the drip-stop. The drip-stop is a common functional detail in building trim which limits the horizontal travel of water on the underside of certain exterior architectural elements. Liquid cannot span this groove and therefore is shed at the perimeter. Top scrim-retaining groove 30*h* is located in the underside of the capital, equal in diameter to the smaller end of the assembled tapered scrim. Top scrim-alignment hole 30*j* is located at a radial position corresponding to previously discussed and illustrated bottom scrim-alignment hole 33*g* (as shown in FIG. 3). In the first step of the installation, the assembled columnar scrim is pressed into circular scrim-retaining groove 33*f* in the column base, with the protruding bead of the rolled outer clasp fit in the bottom scrim-alignment hole. This fixes a radial location; the scrim may not be rotated or repositioned in the scrim retaining groove. Female repeated-use fasteners 35*b* in the underside of the capital are then aligned with male counterparts 35*a*, and, simultaneously, the top end of the rolled outer clasp with the top scrim-alignment hole. Referring again to FIG. 7, the top edge of the scrim is pressed into groove 30*h* concurrent with the engagement of the repeated-use fasteners. The drawing action of the pins and sockets seats capital 30 securely against housing top gasket 36 (FIG. 3). The consistent radial positioning of the alignment holes guarantees that the square abacus and the square plinth will be similarly oriented. Furthermore, the alignment holes locate the longitudinal seam on a rear surface which is generally hidden from view.

FIG. 8 shows an exploded view of the corbel speaker according to a preferred embodiment of the present invention. Drip-stop 56*d*, including an incused groove, is formed around, but slightly inset from, the perimeter of the underside of the shelf. Corbel crossover assembly 64 including corbel crossover circuit-board 64*d* is located in substantially hollow interior 57*a* of corbel speaker housing 57. Midrange speaker lead wires 64*a*, 64*a*' and tweeter lead wires 64*b*, 64*b*' are fed through corresponding midrange openings 58*a*, 59*a* and tweeter openings 58*b*, 59*b* in right speaker mounting panel 58 and left speaker mounting panel 59. Left speaker mounting panel 59 including panel mounting holes 59*c* is then inset in recess 57*b* and affixed with panel-retaining screws 65; right speaker mounting panel 58 is installed in an equivalent manner. Midrange vibration-damping gaskets 61, 61' and tweeter vibration-damping gaskets 63, 63' are positioned around the perimeter of corresponding openings. Midrange speakers 60, 60' and tweeters 62, 62' are then connected to appropriate leads and secured with speaker-retaining screws 66. Scrims 67, 68 are then positioned and set in place with bezels 69, 70. Bezels are manufactured of an elastic silicone rubber or thermoplastic material to minimize risk of breakage during installation and to dampen any vibration of the scrims, and are molded with ornamentation 70*a*. The cross-section of any given segment of the bezel will be L-shaped. The ornamented leg of the "L" overhangs the scrim and thereby prevents its dislocation, much in the manner that art is retained in a picture frame. The plain leg of the "L" fits in scrim bezel groove 571 in corbel speaker housing 57. The width of the scrim bezel groove is similar to that of the plain leg of the "L." Friction and momentary deformation of the elastic bezel material during installation cause the bezel to be firmly retained in the groove and securely held against the corbel scrim. The method of attachment of shelf 56 to corbel housing 57 is best described in the subsequent discussion of speaker mounting methods.

Three distinct mounting methods for the corbel speakers will now be described in reference to FIGS. 9 to 11 inclusive. In each of the three methods, the mounting may be further understood in reference to the overview of the systems' installation illustrated in FIGS. 12A and 12B.

Figure 9A:
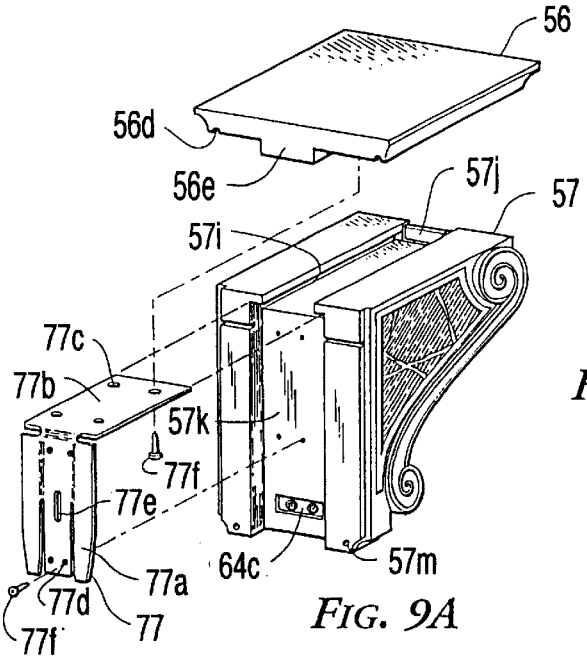
FIG. 9A is a partially exploded view of the corbel speaker and a procedure for mounting the device to a wall.

FIG. 9A shows angled mounting bracket 77, of die-cut and stamped metal, including right-angle extension 77*b* which is fixed to the underside of shelf 56 with screws 77*f* inserted through shelf-attachment holes 77*c*. The outer edges of the right-angle extension overhang raised area 56*e* on the bottom of shelf 56. This assembly of the shelf and angled mounting bracket creates a "T" which may then be inserted in wide T-slot 57*i* on the top surface of corbel speaker housing 57. To complete the corbel speaker assembly, bracket mounting screws 77*f* are inserted through housing-attachment holes 77*d* and secured. Speaker-wire contact plate 64*c* is located on the back of the corbel speaker, below attached bracket 77.

Figure 9B:
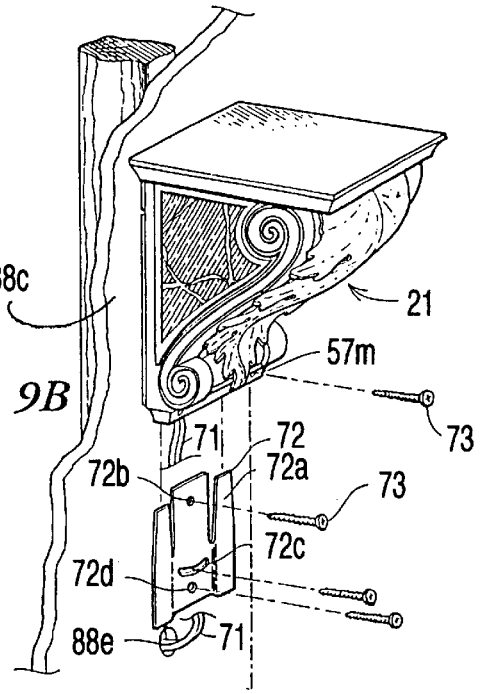
FIG. 9B is a partially exploded view of the corbel speaker and a procedure for mounting the device to a wall.

Installation of left-channel corbel speaker 21 is shown in FIG. 9B. Metal wall-mounting plate 72 having offset slotted flanges 72*a* is fixed to room left-wall 88*c* including wire-hole 88*e*, as follows: first, corbel speaker installation screw 73 is inserted through top screw-hole 72*b* and driven into the existing wall. Since the corbel speaker will often serve a load-bearing function, it would generally be considered advantageous to align the central vertical axis of wall-mounting plate 72 with an existing stud or other reliable solid material. Alternately, hollow-wall type fasteners such as molly-bolts may be employed. Leveling screw-hole 72*c* is elongated in an arc of a radius equal to the distance between the top screw-hole and the leveling screw-hole. A second corbel installation screw is inserted through the leveling screw-hole, and driven into the wall until a slight tension is created between the wall and the wall-mounting plate. This permits the wall-mounting plate to be pivoted, with some resistance, about the top screw-hole. Angled mounting bracket 77 including slotted offset flanges 77*a*, having previously been securely attached to the corbel speaker, is then engaged with the slotted flanges of the wall-mounting plate, and the entire corbel speaker assembly pivoted to a level position. The speaker is then momentarily dismounted and a screw installed through permanent screw-hole 72*d* in the wall-mount plate to fix the plate's position and thereby prevent further pivoting. Corbel speaker-wire 71, having been fished through wire-hole 88*e*, is connected to speaker-wire contact plate 64*c* (as shown in FIG. 9A), and the corbel speaker remounted onto the wall. The interlocked wall-mounting plate and angled mounting bracket are housed by mounting plate recess 57*k* in the back of the corbel speaker housing (FIG. 9A). The oppositely offset flanges create a channel or chase between the metal faces through which the speaker-wire may be freely maneuvered during installation. The speaker may electively be secured against pilferage or accidental dismounting by driving screws into the wall through the corbel speaker housing's security screw-holes 57*m*. Screw-anchors and non-reversing screws may be employed as required by the particular installation.

Figure 10A:
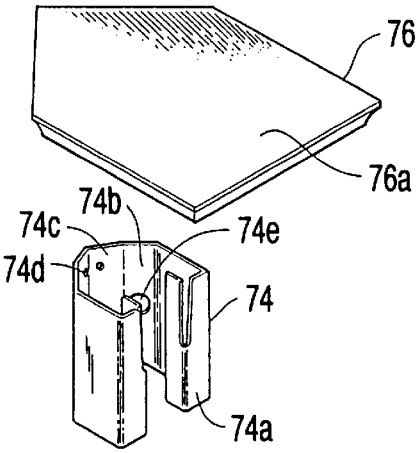
FIG. 10A is a perspective view of components employed for mounting the device of FIG. 1A to an existing corner wall.
Figure 10B:
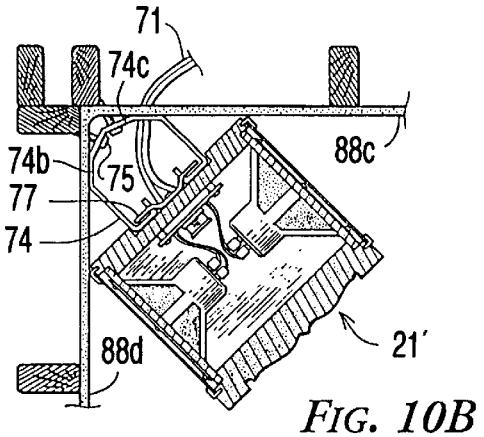
FIG. 10B is a transverse sectional view of the device of FIG. 1A mounted to an existing corner wall.

The corbel speaker's angled mounting bracket allows the standard shelf to be independently disengaged from the housing. Shelves of differing size and shape may thus be readily mounted in the same position. An example of such a modification is illustrated in FIGS. 10A and 10B. FIG. 10A shows corner-mount wall bracket 74 and pentagonal shelf 76 including flat display surface 76*a*, together devised for mounting the corbel speaker in an inside-corner wall. The speaker shown here by way of example is left rear channel speaker 21' and is mounted in a corner including left-wall 88*c* and rear-wall 88*d*. The corner-mount plate includes slotted folds 74*a* formed to accept slotted flanges 77*a* on the speaker's corbel-mounting bracket. Wall contact faces 74*b* of the corner mounting plate are at right angles to one another. Inner obtuse folds 74*c* are at an approximate angle of 135°, as may be seen in the transverse sectional view of FIG. 10B. The obtuse angle prevents the corner mounting plate from being obstructed by the fillet of plaster or joint-compound commonly encountered at the juncture of inside-corner walls. A further advantage of these obtuse-angled inner folds may be observed in further reference to FIG. 10B. If the inside-corner wall is of standard construction, corner mounting screws 75 driven orthogonal to those surfaces will have a greatly increased chance of engaging securely in a stud. Since the wall-mount plate bears on two walls, it will generally be self-leveling. A hole in wall 88*c* may be marked using wire-feed hole 74*e* as a guide, and speaker-wire 71 fished through the wall and connected to the speaker-wire contact plate. The speaker is then mounted into its final position on the inside-corner wall.

Figure 11:
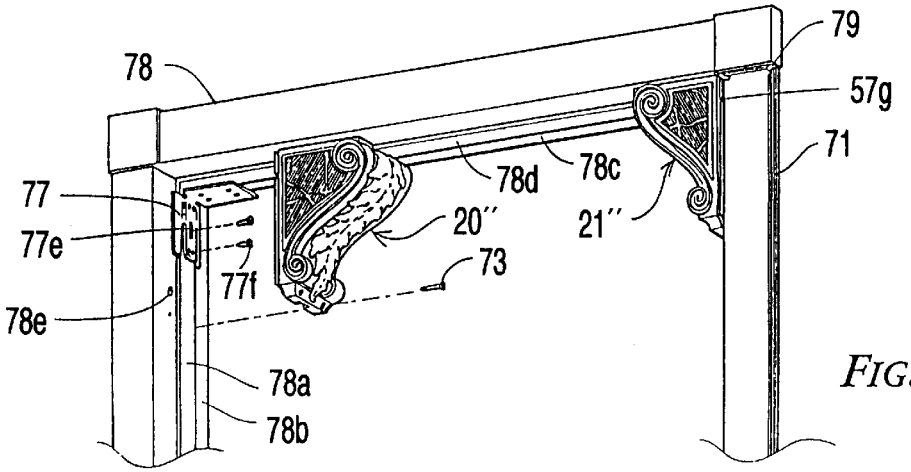
FIG. 11 is a partially exploded view of the corbel speaker and a procedure for mounting the device into a doorway.

A third mounting method is portrayed by speaker 20" in FIG. 11. In this case, no shelf is used. Instead, angled mounting bracket 77 is dismounted from the housing and installed near the top of existing door frame 78. Removable tab 57*j* (as shown in FIG. 9A) is disengaged from the speaker housing to provide clearance for head-jamb stop 78*d*. Vertical adjustment and permanent installation of bracket 77 are made using bracket mounting screws 77*f* in elongate vertical adjustment hole 77*e* and housing-attachment holes 77*d*. The screws are reversed relative to their prior use and driven into side-jamb 78*a* and side-jamb stop 78*b*. Speaker-wire is fished through hole 78*e* drilled in the door frame and connected to the speaker-wire contact plate. For final installation, the uppermost surface of the speaker is first placed substantially flush to head-jamb 78*c*, and horizontal leg 77*b* of the angled mounting bracket is inserted in T-slot 57*i* on the top of the speaker housing. The corbel speaker is then slid into place, concealing the speaker-wire. Installation is completed by driving installation screws 73 through security screw-holes 57*m* into the door frame. An alternate wire installation is shown by corbel speaker 21". Speaker-wire 71, having been fed through horizontal wire-channel 57*g* to the speaker-wire contact plate during mounting, is tacked with cushioned wire-staples 79 to the door frame.

A significant characteristic of preferred embodiments are their adaptability to a wide variety of visual and acoustical environments. The diversity of environments, and of potential adaptations of the present invention to those environments, cannot be fully represented here; instead, a single schematic room 88 is shown in FIGS. 12A and 12B to demonstrate a few elementary arrangements.

The human visual system naturally seeks patterns. Therefore, the multiple repetition of an identical design, as is typical in currently available multi-channel audio systems, makes the speakers unduly prominent in the visual setting. A multi-channel system including both column speakers and corbel speakers, however, has the advantage of being both visually integrated and visually diverse; the speakers may share a common style or ornamental tradition, yet differ in scale and form. This diversity is a significant advantage in a multi-channel audio or home-theater system, where typically at least four speakers are placed at a distance from the central electronic components.

Figure 12A:
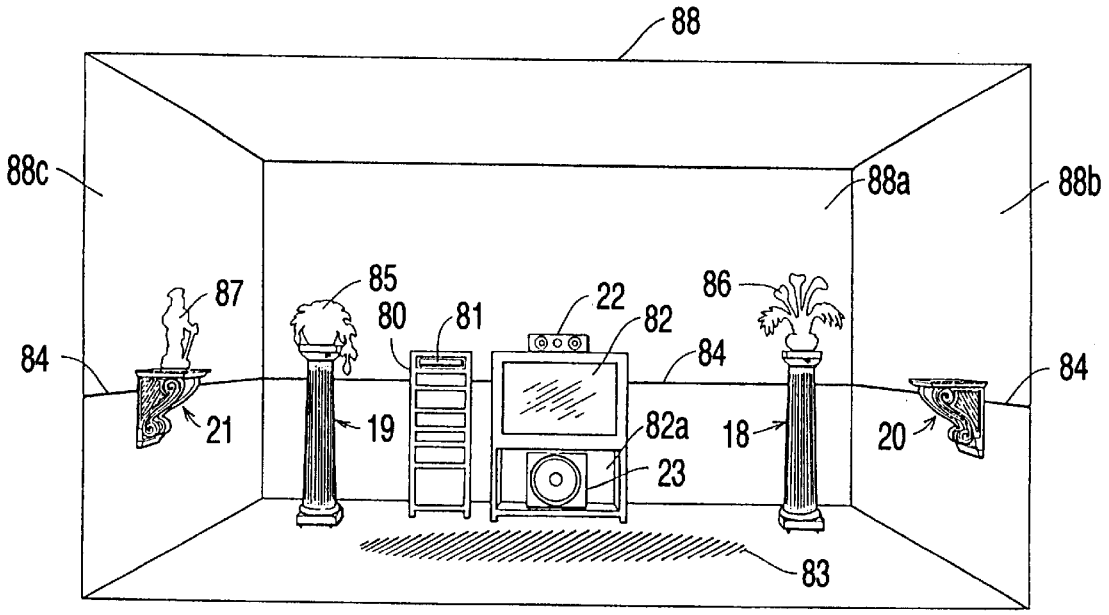
FIG. 12A is a schematic perspective view of a room in which a multi-channel audio-visual system according to an embodiment of the invention is installed.
Figure 12B:
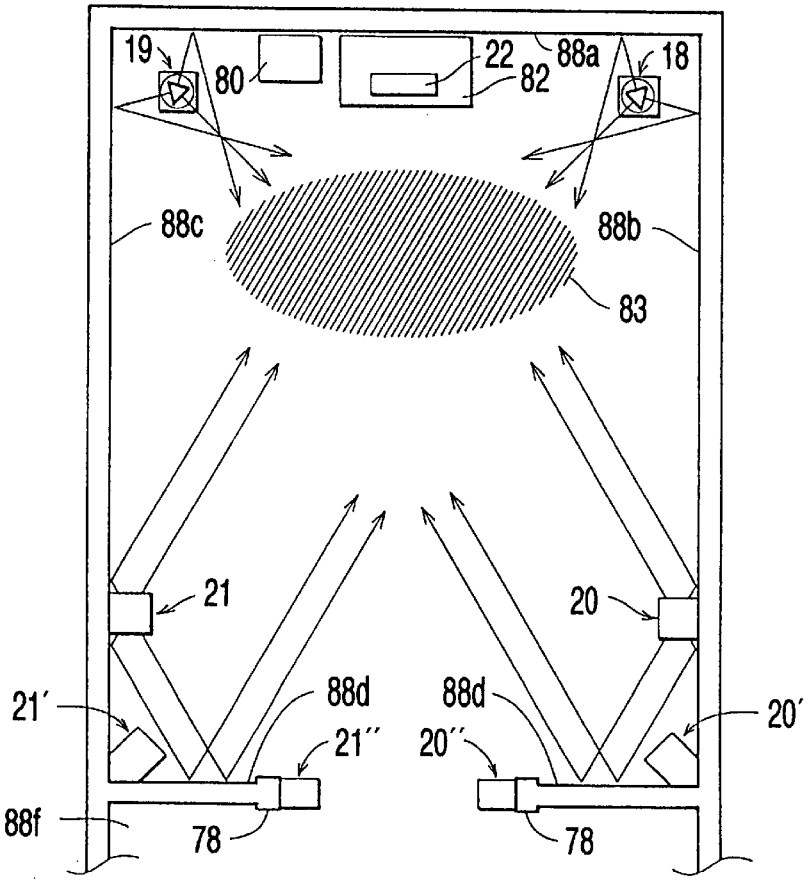
FIG. 12B is a schematic plan view of the room of FIG. 12A.

FIG. 12A is a perspective view of a room in which a multi-channel system including corbel and column speakers has been installed; FIG. 12B is a plan view of the same scene. Video cabinet 82 is located centrally along an interior wall. Preferred seating area 83, indicated by a hatched elliptical footprint, is defined at a comfortable viewing distance from the video screen. The targeted acoustical area is defined by the vertical extension of seating area 83 and ear-level plane 84. These geometric figures intersect in an elliptical area at ear-level immediately above the footprint of the seating area. In practice, this target area would be imagined as a three-dimensional ellipsoid, since listeners of differing ear-heights often need to be accommodated simultaneously. Audio and video electronics 81, typically including a videocassette recorder (VCR), compact disc (CD) player, cassette deck, radio tuner, and signal amplifier, are located in audio cabinet 80 in proximity to the video cabinet.

Two column speakers 18, 19 are assigned to reproduce the right and left front channels respectively. The two column speakers are located in opposite corners of the room, flanking the video cabinet in a symmetrical fashion. Each of the column speakers conceals, as previously shown, a triangular speaker housing. The face of the housing on which the tweeter, midrange, and woofer are mounted is oriented to substantially face the seating area. Note that this may be achieved while maintaining the alignment of the square abacuses and plinths with the walls. The column speakers are also located at a distance from the walls which optimizes horizontal diffusion of sound reproduced from the reflecting speakers. Right columnar speaker 18 is substantially equidistant from front-wall 88*a* and right-wall 88*b*. Left columnar speaker 19 is substantially equidistant from front-wall 88*a* and left-wall 88*c*. Each column speaker includes two wide-spectrum speaker elements carried on different faces of the speaker enclosure. Acoustical energy reproduced by these elements reflects off proximate walls, while sound from the front face reaches the listener in a direct or radiant fashion. This effect is represented schematically by the arrows surrounding speakers 18 and 19 in FIG. 12B. A listener will perceive this effect collectively as a broadening of the acoustical fields beyond the physical limits of the speaker themselves. The breadth of these fields may be adjusted by moving the speakers into or out of the corners.

The right and left rear channels are assigned to corbel speakers 20, 21, respectively. The alignment of the four speakers on the same transverse plane is considered ideal for precise acoustical imaging. Sound reproduced by the dipole corbel speakers arrives in the acoustical target area by a diversity of pathways. As the four arrows emerging from each speaker indicate, sound energy may reach a listener directly, after reflection from right wall 88*b* or left wall 88*c*, or rear wall 88*d*, or after reflection off both a side wall and the rear wall. In home-theater systems, the acoustics of a very large theater must be simulated in a much more confined space.

Systems have therefore been developed which modify the recorded signal and coordinate it with the output devices, and thereby guarantee to a consumer that a given system will deliver a credible depth of acoustical illusion. A well known home-theater certification program is Lucasfilm's THX™ system. The corbel speakers' dipole configuration generates the horizontally-diffused acoustical fields required for such certification. The best locations for attaining such rear-channel horizontal diffusion are along facing side walls. Alternate satisfactory locations of the corbel speakers, consistent with the mounting methods previously described, are indicated at the rear corners of the room by corbel speakers 20', 21', and in door frame 88 by corbel speakers 20", 21". It may be seen in reference to FIG. 12B that both the direct/reflecting column at the front speakers and the dipole corbel speakers at the rear deliver horizontally-diffused but highly directional sound waves in an effective manner to the targeted area.

Center-channel speaker 22 is located immediately above the video screen. A four-channel, five-speaker arrangement, wherein the right and left rear speakers share the same monaural "surround" channel, is typical in current multi-channel audio-visual systems. In a so-called 5.1 system these five speakers are enhanced by the stereophonic separation of the rear channels and a dedicated, almost sub-audible, low-frequency effects (LFE) channel. This is usually assigned to an independently powered sub-woofer 23, often placed in vacant recess 82*a* beneath the video screen. The most accepted of these systems are the Dolby™ SURROUND™/Dolby™ PRO LOGIC™ four-channel matrix and the Dolby™ DIGITAL/AC-3™ digitally-compressed 5.1 systems.

As may be seen in FIGS. 12A and 12B, it is only the front and rear speaker pairs which are at large in the interior environment; the remaining components may be clustered and enclosed when not in use. If the speaker-wires leading to the front and rear pairs of speakers are conscientiously installed, there will be little visual indication of the actual sound source. As previously stated, the ability of a listener to pinpoint a sound source often depends upon visual reinforcement or confirmation of the source's location. The self-evident utility of most speaker systems guarantees that these limiting visual cues are provided. Even in loudspeakers having reflecting speaker arrays, where acoustical waves are bounced off hard surfaces to generate a more diffused audio source, the obvious functionality of the loudspeaker partly negates the measurable diffusion. The brain's dominant visual sensory system tries to fit the acoustical field into its apparent source. This type of cognitive self-deception is precluded by concealing the source of sound. In embodiments of the present invention, the manifest utility is altered so that the suggested load-bearing or display function of the devices, rather than their acoustical purpose, is visually dominant. This display function may be reinforced, as in FIG. 12A, by the disposition of customary ornamental objects, such as house plants 85, flower arrangements 86, or decorative objects 87, upon the superior surfaces of the at-large speaker units. These ornamental objects may be selected to further integrate the speakers with the surroundings. Speaker elements and circuitry are isolated from the accidental ingress of water or other fluid by the concealed drip-edges and by the structurally independent metal scrim. Speakers may also be left unadorned for occasional or casual use.

The constituent materials of the speakers' visible surfaces, metal and MDF, are readily top-coated by brush or aerosol application. The printed scrim pattern thus may be electively covered at any point in the speakers' useful life with user-determined pigments which match those in the speakers' current environment. Because the marble pattern is in the perforations as well as the printing, a scrim coated with a monochromatic finish will still convey an impression of a natural material. Such elective coloration might be effected prior to the initial installation of the speaker system.

Subsequent drawings illustrate modifications to embodiments of the present invention. A first modification is the independent use of either the column or the corbel speakers in units or pairs in a traditional monaural or stereophonic system. Dipole corbel speakers may be mounted between rooms to generate sound in two rooms at once. Corbel speakers 20", 21 " shown in FIG. 12B would, considered without the other speaker components, reproduce sound into both room 88 and adjacent room 88*f*. The speakers would retain the perceptual advantages previously cited.

Figure 4E:
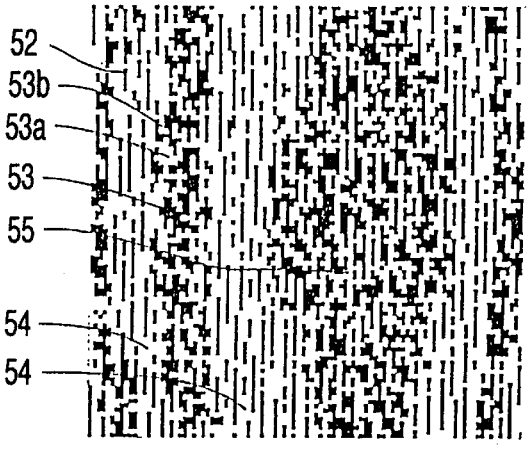
FIG. 4E is a non-periodic screen aperture pattern derived from an image of flat-sawn wood-grain.

FIG. 4E shows a screen pattern derived to simulate wood. Certain natural patterns, such as wood grain, have a marked directional bias. At low resolutions, such patterns are not best represented by image screens composed of round dots. A somewhat improved directional effect may be obtained, in a dot screen, by specifying elongate elliptical dots. A more effective illusion, however, is conveyed by a pattern of the type shown in FIG. 4E. FIG. 4E is a non-periodic irregular pattern including elongate rectangular apertures 52. The generalized shape of a typical aperture mimics the elongate cells or tyloses of a ring-porous hardwood such as oak or ash. The gross pattern is characterized by alternating darker "spring-wood" 53 bands and lighter "summer-wood" bands 54; these imitate the seasonal growth pattern revealed in planks sawn from such ring-porous wood. Broad, "flat-sawn" center 55 of the pattern may be located over a speaker element, as the acoustical transparency in that area will be greatest. The apertures are arranged so that no large areas are wholly removed. Spans 53*a* and cantilevered tabs 53*b* extend from the edges of the visually dark, acoustically transparent zones; these structures optically interrupt and physically reinforce the more open areas. These limiting parameters may be written into an extension of the image-editing application's core algorithm to generate the detailed original source image for the perforating dies. The resulting image may be used to prepare a photo lithographic template as in FIG. 4A, or converted to a CNC-readable format as in FIG. 4B, or read as a binary source by an optical-stylus machine controller. Further processing would be similar to that previously described with respect to FIGS. 4A and 4B for the fabrication of the marble scrim.

Figure 13A:
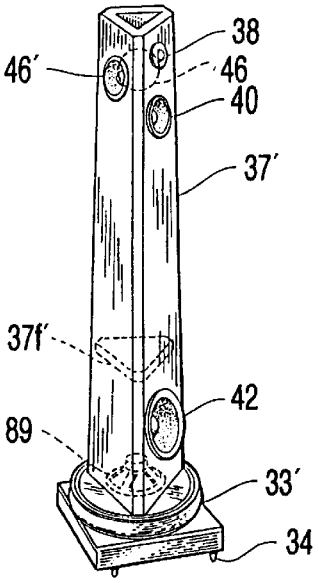
FIG. 13A is a perspective view of a base and internal housing of a modified columnar speaker.
Figure 13B:
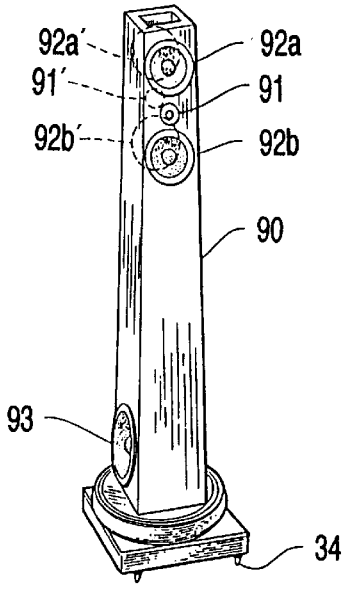
FIG. 13B is a perspective view of a base and internal housing of a modified columnar speaker.
Figure 13C:
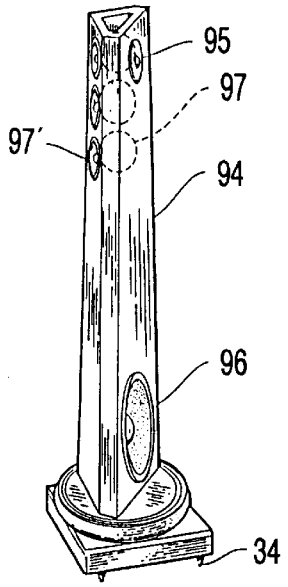
FIG. 13C is a perspective view of a base and internal housing of a modified columnar speaker.

In FIG. 13A, 13B, and 13C, modifications of the speaker housing are illustrated. For the sake of clarity, the capitals and acoustically transparent scrims are not shown. A great degree of design flexibility is attained by allowing a conventional speaker housing to be wholly enclosed within an acoustically transparent scrim; the acoustical housing and the visible surface are then substantially independent. The invisibility of the housing allows it to be optimized acoustically without consideration of its visible form. Variations of the housing include FIG. 13A, similar to that of the preferred embodiment but further including down-firing passive bass-radiator 89. The vent port has been eliminated in modified housing 37' to allow the internal air pressure to drive the passive radiator. In order to maintain constant air volume in the bass chamber, the active and passive bass-radiators may be isolated from the other speaker elements by a transverse internal partition or baffle 37*f*'. Modified base 33' includes an opening of sufficient diameter to accept the passive bass-radiator. The remaining attributes of this modification are similar to the column speaker discussed previously, and are numbered accordingly.

The speaker of FIG. 13B includes a housing of quadrilateral transverse section 90 having a tripole configuration comprising, on its front face, tweeter 91, and acoustically identical upper and lower midrange speakers 92*a*, 92*b*. A similar array is located on the rear face, including tweeter 91' and midranges 92*a*', 92*b*'. Side-firing woofer 93 provides bass frequencies. In FIG. 13C, bilaterally symmetrical housing 94 of irregular pentagonal transverse section includes speaker elements in a tripole configuration. The broadest side of the pentagonal housing is occupied by tweeter 95 and woofer 96 in direct or radiant operation. Arrays of midrange speakers 97, 97' occupy the two sides of intermediate width, and operate in a reflecting mode. Additional, more complex developments of the column speaker might include one or more resonant chambers, horns, or wave-guides of tubular, folded, or helical form to enhance or amplify the sound delivered by the speaker elements.

Figure 14A:
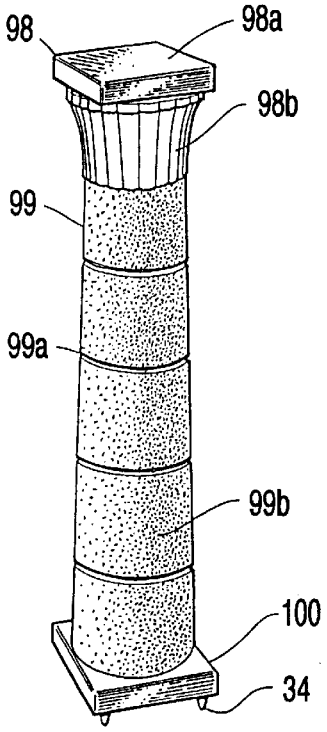
FIG. 14A is a perspective view of a modified columnar speaker in the Egyptian style.
Figure 14B:
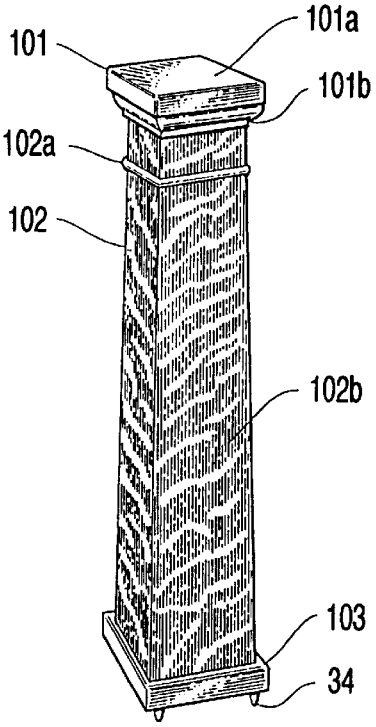
FIG. 14B is a perspective view of a modified columnar speaker in the form of a column in the Mission style.
Figure 14C:
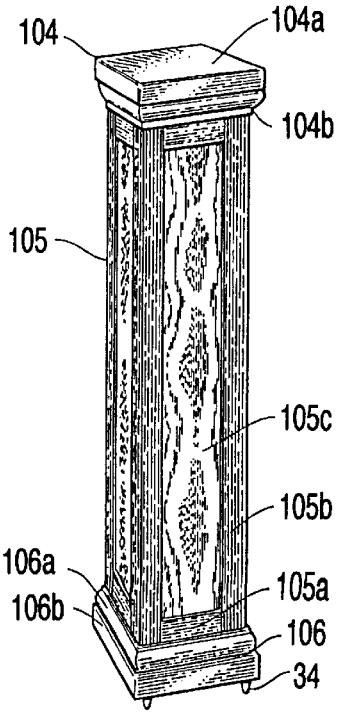
FIG. 14C is a perspective view of a modified columnar speaker in the form of a column cased with frame-and-panel trim.

Examples of modifications to the external aspect of the columnar element are shown in FIGS. 14A, 14B, and 14C. FIG. 14A is a column having its visible surfaces formed in a style which might be described as Egyptian or Pergamene. Here the elements of capital 98 are represented by abacus 98*a* and reeded flared surface 98*b*. In acoustically transparent scrim 99, column-drum seams 99*a*, rather than flutes, are suggested by the surface embossment. Apertures 99*b* are made in an irregular or stochastic pattern to suggest the granular surface quality of sandstone. Unornamented plinth 100 is similar in form to the plinth discussed previously. FIG. 14B is a column speaker in a style which might be described as Arts and Crafts, or Mission, in that its surface details are inherited from the Classical orders but are adapted to a column of square transverse section. This modification includes Mission capital 101, Mission shaft 102, and Mission base 103. Mission capital 101 includes abacus 101*a*, and top molding 101*b* of a profile similar to a Doric echinus. Mission column shaft scrim 102 includes raised collar-bead 102*a*. Columns in the Mission style were usually constructed of rift- or quarter-sawn oak; this distinctive grain pattern is imitated by elongate apertures 102*b* in the scrim. Mission base 103, as well as capital 101, may be veneered or otherwise decorated to match the pattern of the simulated rift-sawn oak shaft. FIG. 14C is a further modification of the present invention, in the form of a column having frame-and-panel casing, and includes capital 104, cased-column shaft scrim 105, and base 106. Abacus 104*a* is situated above top moulding 104*b*. The column is substantially square in cross-section, having the suggestion of rails 105*a*, stiles 105*b*, and panels 105*c* made by both the surface topology and the local orientation of the simulated wood-grain. The cased-column base 106 includes moulding 106*a* and plinth 106*b*. In other imagined modifications in the tradition of Neoclassical architecture, columns of round transverse section might be mounted on such pedestals of square section, and thus might combine diverse elements of the illustrated examples.

Figure 15A:
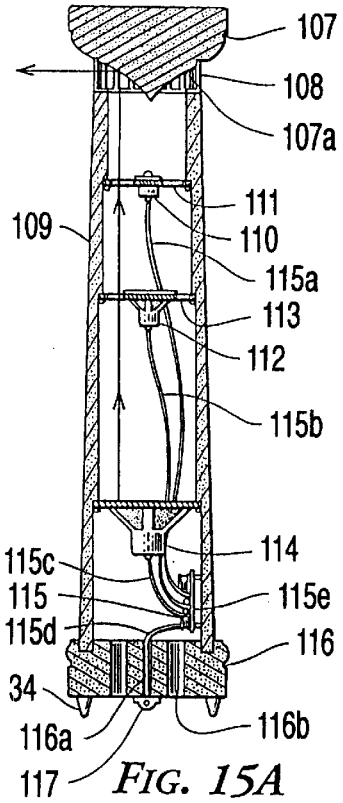
FIG. 15A is a sectional elevation view of a modified columnar speaker having coaxially mounted upward-firing speaker elements.
Figure 15B:
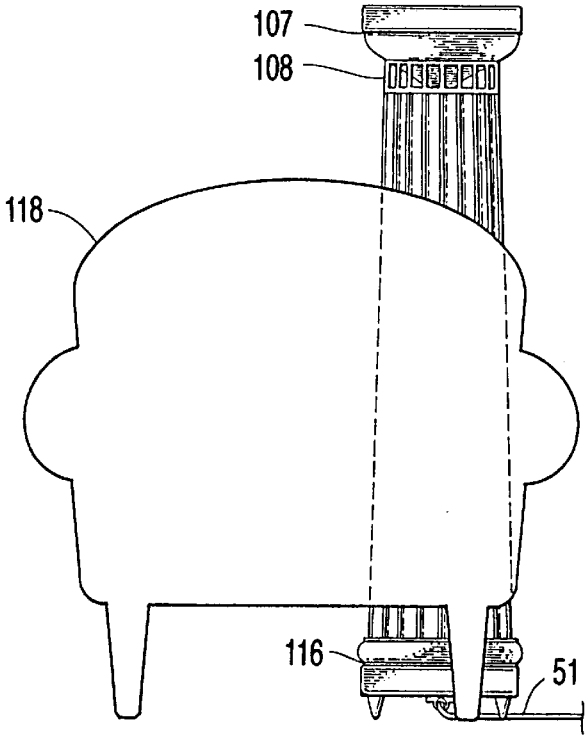
FIG. 15B is a schematic view of a sound-absorbing environment including the device of FIG. 15A.

A modification having a co-axial speaker array is shown in FIGS. 15A and 15B. In this embodiment, column shaft 109 is not acoustically transparent, but rather is constructed of solid opaque material, as are capital 107 and base 116. The speaker elements are mounted coaxially in a staggered upward-firing configuration within the hollow shaft. Tweeter 110 and midrange 112 are suspended on open armatures 111, 113 respectively, so that a significant amount of acoustical energy passes from all speaker components to radial reflector 107*a*. The lowest tier is occupied by woofer 114, which is vented through ports 116*b* in the column base. In the illustrated example, the externally visible area of the reflector surface has the appearance of a Doric-style echinus. Open cylindrical grille 108 allows sound waves to pass omnidirectionally into the surrounding environment. Crossover assembly 115 includes leads 115*a*, 115*b*, 115*c*, for the tweeter, midrange, and woofer, respectively, which are connected to co-axial speaker crossover circuit-board 115*e*. Jumper wire 115*d* passes through jumper hole 116*a* and connects the circuitboard to jack 117. Conical feet 34 create a vacant space beneath the column base. A discrete connection to a remote audio source may then be made using speaker-wire 51. The elements of this embodiment are readily formed of paintable materials such as MDF and metal. This speaker might be provided in a primed but unpainted state, and finished on-site to match existing architectural trim. The relatively large grille apertures would allow satisfactory results to be attained even by unskilled finishers. Another advantage of this embodiment is shown in FIG. 15B, where a significant portion of the column speaker is masked by sound-absorbing object 118 in the local environment. The elevated position of the reflector allows the sound to pass in an effective manner into the surrounding area. The omnidirectional acoustical radiation pattern makes this embodiment especially suitable for larger architectural spaces or more central room locations, where conventional, highly directional radiant speaker arrays would generate an unacceptably erratic acoustical impression.

Figure 16A:
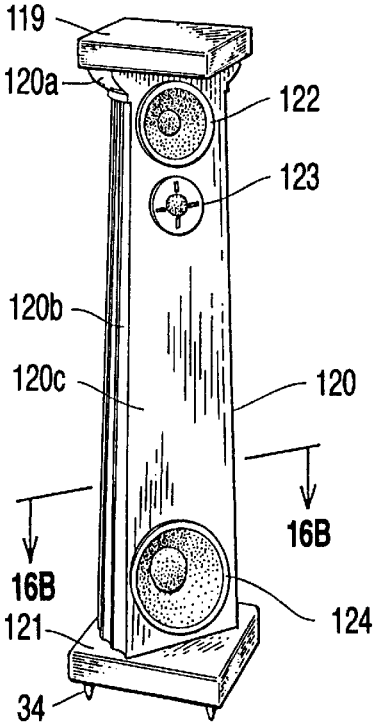
FIG. 16A is a perspective view of a modified columnar speaker having a D-shaped transverse cross-section.
Figure 16B:
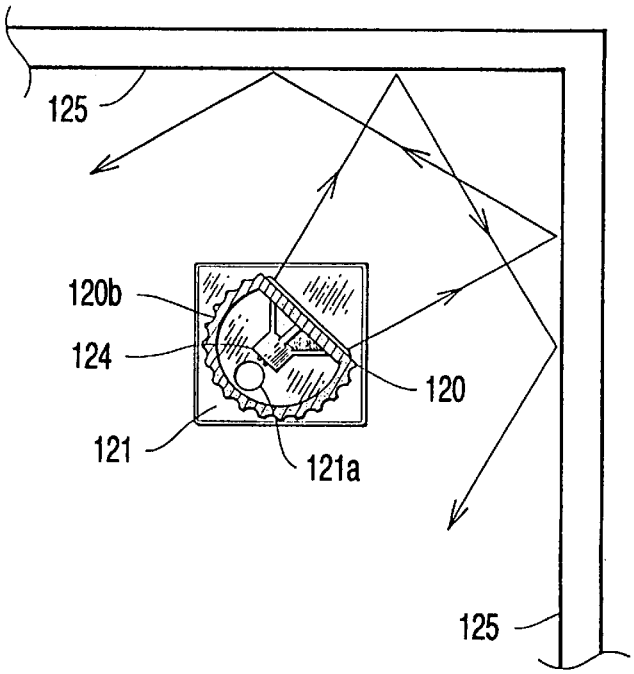
FIG. 16B is a transverse cross-sectional view of the speaker of FIG. 16A in operation.

A modification suitable for use in a reflective mode is shown in FIG. 16A. Elements familiar from other embodiments include abacus 119, echinus 120*a*, fluting 120*b*, base 121, and feet 34. In this embodiment, however, the reflecting-type speaker housing 120 has an essentially D-shaped transverse section, with the curved portion of the "D" typically representing two-thirds of a circle and the straight portion a chord connecting the interrupted ends of that circle. Flat rear face 120*c* of this columnar speaker is mounted with midrange 122, tweeter 123, and woofer 124. FIG. 16B shows a transverse sectional view of the D-shaped speaker in operation. Vent port 121*a*, formed in the base, is revealed in this view. In operation, the flat face of the speaker housing is oriented towards existing wall 125, whereby the flat surface discontinuity is hidden from a casual observer. The reflected acoustical field thus again has no visually obvious source. Permutations of these modifications may be readily imagined in reference to the stylistic variations illustrated in FIGS. 14A, 14B, and 14C.

Figure 17A:
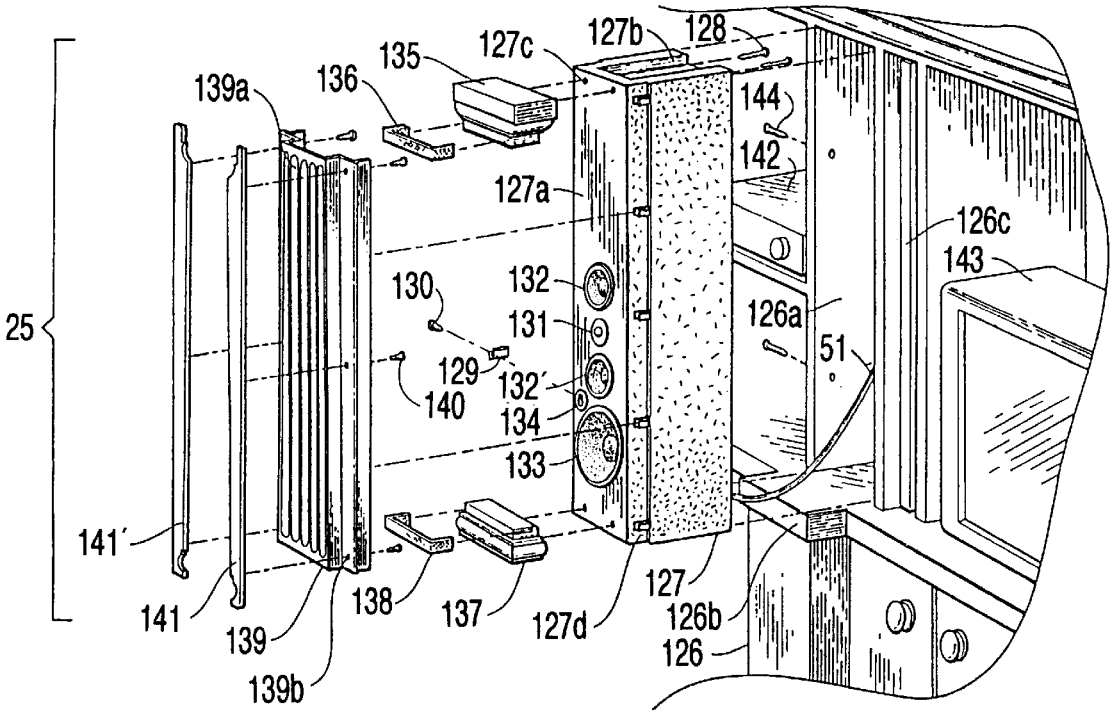
FIG. 17A is an exploded view of a modified columnar speaker designed for installation in existing cabinet-work.
Figure 17B:
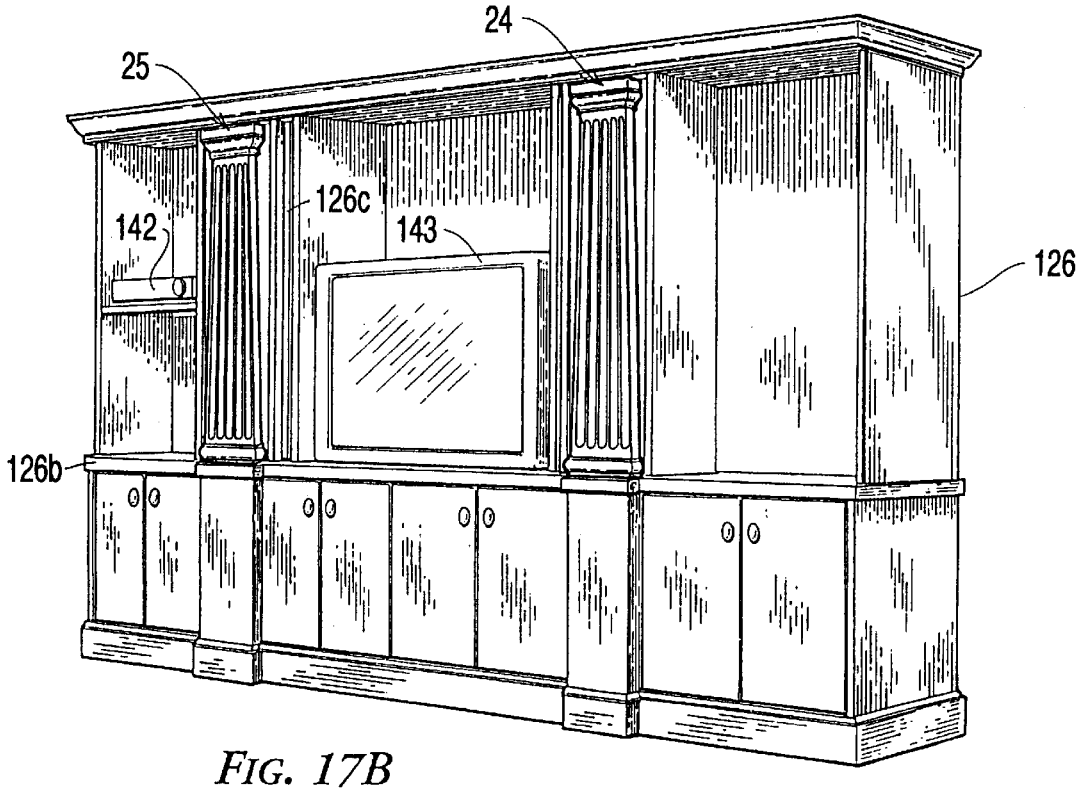
FIG. 17B is a perspective view of the completed installation shown in FIG. 17A.

In architectural practice, columns are often immured in an engaged, half-round form or as a bas-relief variation known as a pilaster. FIGS. 17A and 17B show an embodiment wherein the pilaster form is employed in an opportune manner. In this modification, pilaster speaker 25 is provided so as to fit in expressly devised recess 126*a* in cabinet-work 126. For ease-of-use, the size of this opening is specified by the speaker manufacturer at a dimension incrementally larger than the speaker enclosure, ideally in whole units of measure. By way of example, a pilaster speaker designed to rest on counter 126*b* of standard height might specify an opening about 120 cm high, about 25 cm wide, and about 30 cm deep, with about 5 cm additional forward clearance for the pilaster relief. Pocket doors 126*c* adjacent to the recess and to video screen 143 allow the screen to be electively concealed. In the version illustrated in FIGS. 17A and 17B, speaker housing 127 is of unfinished MDF, except for front face 127*a*, which is covered in matte-black melamine laminate. Speaker elements, including tweeter 131, midranges 132, 132', and woofer 133, are located at optimal listening heights, typically closer to the bottom of the housing than the top. Vent port 134 is located just above the woofer. Counter heights vary little in cabinet construction, and are nearly always between 76 cm (thirty inches) and 92 cm (thirty-six inches) from the floor. The probable ear-level of the audience may thus be anticipated with significant reliability, and the configuration of speaker elements tailored to produce a great degree of realism. The top and bottom panels of speaker housing 127 are set in dados in the right, left, and front MDF panels. Raised lips or extensions 127*b* are thereby created on those three sides of the housing. Mounting holes 127*c* through these lips near the top and bottom of the front panel permit pilaster capital 135 and base 137 to be discretely secured with screws 128. Spring steel scrim-retaining clips 129, each having a rolled edge to ease insertion, are installed with countersunk flat-head screws 130 in rabbets 127*d* formed in the speaker housing.

Vibration-damping gaskets 136, 138 are adhered to the capital and base, respectively. Pilaster scrim 139 is shown having flutes 139*a* embossed on its front surface. Plywood trim-panels 141, 141' are provided whose edges substantially abut both the interior perimeter of the existing cabinet opening and the edges of the raised pilaster relief. The plywood trim-panels may be painted, stained, or used as templates for custom cabinet-work. The trim-panels, or custom duplicates derived from them, are affixed to the scrim by driving trim mount screws 140 through holes 139*b* in the scrim.

Speaker-wire 51 from audio source 142 is connected to contacts on rear of pilaster speaker 30 housing 127. The housing, with the capital and base attached, is slid into the cabinet. Movement may be arrested at a predetermined depth by a stop-block (not shown) installed in the cabinet recess. The housing may then be secured from both sides with set-screws 144. The scrim edges are aligned with the scrim retaining clips, and the scrim and trim assembly pressed in place. The scrim retaining clips allow the scrim assembly to be conveniently removed for the inspection, cleaning, repair, or replacement of speaker components.

In FIG. 17B, right and left pilaster speakers 24, 25 have been installed in existing cabinet-work 126. Pocket doors 126*c* would be specified in this installation, as conventionally-hinged doors, when open, might interfere in the acoustical pathway. Conventionally-hinged doors may nevertheless be employed in many other cabinet configurations; the pilaster speakers, for example, might be situated at the outer corners of the cabinet rather than immediately flanking the video screen.

Accordingly, it may be seen that embodiments of the present invention can be advantageously employed in many situations where there is a demand both for high-fidelity sound and for a degree of visual formality. Because of their utilitarian appearance, traditional loudspeakers have often been relegated to informal domestic areas. The dilemma caused by their obtrusive visual presence has recently been compounded, as increased digital-information storage densities have allowed multi-channel sound in both audio and audio-visual recordings. At the same time, improvements in technology and changes in social habits have brought electronic audio and video components into more central and visible areas of the home. The column and corbel speakers according to embodiments of the present invention deliver high-quality sound from a source that is invisible to a casual observer. While traditional systems maximize the similarity of the speakers, in embodiments of the present invention the deliberate diversification of the speakers' forms allows them to blend into their surroundings. In addition, their inconspicuous character and practical display function makes these speakers highly suitable for use in commercial and professional environments, including restaurants, waiting rooms, hotel rooms, lobbies, offices, and retail stores.

Furthermore, the column and corbel speakers have additional advantages in that the concealment of the sound source and reflective acoustics combine to create a highly realistic psychoacoustic effect wherein sound appears to be emitted by a diffuise field in the environment rather than by conspicuous reproducing devices. In addition, the column speakers' visible scrims and their speaker housings are structurally independent, allowing the exterior to be optimized for appearance while the interior is optimized for acoustical fidelity. The fluting on the column speakers acts as a structural corrugation and reduces the requisite thickness of the sheet metal, and furthermore minimizes vibration, denting, and other momentary or permanent deformations of the scrim. Moreover, scrims and speaker housings may be packaged and sold separately, whereby a consumer might select or replace the scrim to match the color and design of a given interior environment. The scrims and housings are readily manufactured in paintable materials, whereby an exact color match might be made on-site between the speakers and key colors in their surroundings. Further, both column and corbel speakers have a complete and practical secondary utility as the display stands they portray, are protected against accidental spills, and are adaptable to surroundings with a wide variety of acoustical, architectural, and stylistic demands.

Clearly, changes may be made to the architectural speakers described and illustrated herein without, however, departing from the scope of the present invention. For example, the scrims might represent materials from outside the architectural tradition, such as fabric, animal hide, or clouds. In fact, since the perforated scrim is preferably derived from a conventional monochrome image screen, it could readily be fashioned to include any sort of text or imagery. The printing process described above can be eliminated and the graphic texture conveyed by the apertures alone. Alternately, the graphic material can be printed on a regular, conventionally perforated screen and still produce a desirable visual effect. Even a scrim formed of conventional, regularly perforated screen and painted a single color could provide a suitable effect, if the relief surfaces were conscientiously formed.

The shape of the apertures employed in the scrims is not limited to any specific geometry, and may be a circle, an ellipse, a rectangle, or any other regular or varied shape. The apertures may be in a regular pattern, such as a rectangular, hexagonal, or sinusoidal grid, but may also be arranged in a stochastic or random fashion. It should be appreciated that the apertures in the scrim need not fully penetrate through the thickness of the scrim material. Thus varying degrees of penetration may be used to impart a texture to the scrim, further enhancing psychoacoustic concealment. Apertures can be created by laser or water-jet cutting, by mechanical perforation dies, or by etching. It should be appreciated that although distortion of the dot screen pattern is most amenable to an etching process, it may also be used with other methods of creating apertures. Moreover, an etching process such as that described herein can be used to form regularly shaped apertures as well as apertures that vary in size, shape, and spacing.

Rather than representing a two-dimensional pattern, the tonal variation of the apertures or the graphic material could be used to mimic a three-dimensional or bas-relief image or texture. The apertures in the column or corbel scrims can be relatively large, and can suggest fretwork, grillwork, or filigree. The perforated scrims might be lined with acoustically transparent fabric, such as Kodak® KODEL® polyester, to further conceal the internal components. Moreover, the scrims may layered with an intervening membrane and be employed as sound-generating electrostatic panels.

The ornamental surfaces of the corbels can be varied according to their extensive architectural tradition, and can be simple, including only brackets or scrolls, or complex, including friezes, fretwork, botanical reliefs, scenes, faces, animal heads, and the like. Acoustically transparent corbel reliefs could be made by the embossing method described for the fluted column scrim; a great variety of speaker configurations could thereby be accommodated. Furthermore, the corbels are typically small enough that they might be economically cast in metals such as aluminum or bronze.

Architectural elements are commonly reproduced with distressed surfaces or in partial form to suggest wear or ruin. These effects can be advantageously combined with the present invention in either interior or exterior versions. In an alternate example of the use of a partial column, a scrim in the form of a Corinthian-style capital might be employed to disguise an independent sub-woofer.

Genuine wood veneer is commonly bonded to reinforcing paper, foil, and plastic laminates. Veneer, or one of these composite laminations, can be bonded to the scrim material to produce an actual wood surface, which could then be stained or dyed on-site with traditional wood-finishing materials.

The scrims need not be made of perforated metal; other materials, such as woven-wire screen, injection molded thermoplastics, open-cell PVC foam, and cast resins can be regularly employed to produce speaker grilles. Various processes also exist for forming a rigid or semi-rigid relief from woven natural or synthetic fiber. Even untreated cloth can convey a convincing columnar impression when stretched over a suitably formed wire armature.

Materials which are transparent to acoustical radiation but opaque or diffusive to visible radiation, such as TEFLON® material, can also be employed, especially if reinforced with polyester fabric. TEFLON® material has the further advantage of being wholly impervious to water, and allow the speakers to be adapted for outdoor use. Acoustically opaque elements may be formed of metal, calcareous cement, concrete, magnesite cement, ABS plastic, rubber, or other weather-resistant material or aggregate.

Many materials and methods exist for simulating natural materials on flat or relief surfaces. Examples which can be advantageously combined with the speaker systems of the present invention include painting with pigmented or textural media, graining with paints and glazes, marbleizing with clays or other surface-borne colorants, and heterogeneous mixed-batch, granular or aggregate casting.

Speaker parts herein described as being formed of medium-density fiberboard (MDF), may alternately be made of wood, injection-molded thermoplastic or any of the various cast plain or aggregate polymer resins, including those (CORIAN® material from Dupont, FOUNTAINHEAD™ material from Nevamar, Surell® material from Formica, and the like) which are commonly composed to simulate stone.

Facsimiles of the architectural speakers, devoid of acoustical components, can also be deployed along with functional speakers. This might be desired as a means to increase display area or architectural detail, without incurring the cost of an operational speaker.

Buzzers, horns, beepers or other audio signaling components can also be substituted for the speaker elements, and the columnar or corbel speakers can be employed as alarms or warning devices, rather than as high-fidelity loudspeakers.

Magnetic fields created by the speaker drivers may be shielded according to conventional practice; such shielding allows placement of the speakers in the immediate vicinity of a CRT or video screen without inducing distortion in the CRT image field. Speaker arrays illustrated herein should be considered schematic, as the particular configuration selected depends upon a diversity of technical, practical, and subjective considerations well known to those practiced in the art. For example, the column speakers described herein have largely been illustrated with the woofers located at the widest point of the column, near the base. It is at this point that the largest speaker cone may be accommodated. Bass frequencies are difficult for a listener to pinpoint, and therefore allow such freedom in speaker placement. Furthermore, this arrangement separates the large woofer magnets from the presumed location of the video screen; magnetic shielding may then be minimized or eliminated, with attendant reductions in weight, materials, and design complexity. Nevertheless, bass speakers may be located close to the top of the column if a woofer of reduced diameter is selected, if an elliptical or oblong cone is used, or if a dual array of less powerful but smaller bass speakers is employed. The speaker housings inside the columnar scrims can be rotatable or repositionable. Musical and cinematic systems often have differing acoustical requirements; speakers might therefore be devised in which the output of certain speaker elements might be adaptively modulated, deflected, diminished or disabled. Speakers can also include controls to correlate the tone or timbre of the various speaker components in a system. The speaker arrays can include integrated but independently powered subwoofers. Enclosures can include fiber filling to improve damping, structural braces, or additional internal baffles. The scrim can be made sufficiently rigid to be employed as a stand for an internal speaker; the speaker would be attached to and suspended below the capital, without any direct connection between the speaker housing and the base. Moreover, a thin perforated metal scrim may be reinforced by electroplating.

Having thus described at least one illustrative embodiment of the invention, various alterations, modifications, and improvements will readily occur to those skilled in the art. Such alterations, modifications, and improvements are intended to be within the spirit and scope of the invention. Accordingly, the foregoing description is by way of example only and is not intended as limiting. The invention is limited only as defined in the following claims and the equivalents thereto.

What is claimed is:

1. An audio speaker, comprising:

at least one speaker element capable of producing acoustical energy from an electrical audio source signal;

a substantially hollow enclosure to support the at least one speaker element, the enclosure including first and second planar surfaces that are parallel to each other, a third planar surface that is perpendicular to and abuts the first and second surfaces, a fourth planar surface that is perpendicular to and abuts each of the first, second and third planar surfaces, and a fifth surface abutting the first, second, third and fourth surfaces to form the enclosure; and means to retain the at least one speaker element in one of the surfaces of the enclosure;

wherein an exterior face of the fifth surface includes relief elements, and wherein the enclosure forms a corbel;

wherein the at least one speaker element includes at least two speaker elements;

wherein each of the first and second surfaces includes an opening to receive one of the at least two speaker elements, the at least two speaker elements projecting acoustical energy in opposite directions; and wherein the speaker further includes means fastened to at least the third surface, for mounting the speaker on a wall.

2. The speaker of claim 1, wherein the relief elements include at least one of scrolls and volutes.

3. The speaker of claim 1, wherein the relief elements are shaped in a form of vegetation.

4. An audio speaker, comprising:

at least one speaker element capable of producing acoustical energy from an electrical audio source signal;

a substantially hollow enclosure to support the at least one speaker element, the enclosure including first and second planar surfaces that are parallel to each other, a third planar surface that is perpendicular to and abuts the first and second surfaces, a fourth planar surface that is perpendicular to and abuts each of the first, second and third planar surfaces, and a fifth surface abutting the first, second, third and fourth surfaces to form the enclosure; and means to retain the at least one speaker element in one of the surfaces of the enclosure;

wherein an exterior face of the fifth surface includes relief elements, and wherein the enclosure forms a corbel; and wherein the at least one speaker element is retained in the first surface, the speaker further comprising a scrim covering an outer face the first surface, the scrim having a degree of acoustical transparency and a degree of optical opacity that conceals the at least one speaker element from view.

5. The speaker of claim 4, wherein the relief elements include at least one of scrolls and volutes.

6. The speaker of claim 4, wherein the relief elements are shaped in a form of vegetation.

7. An enclosure for an audio speaker, comprising:

a plurality of surfaces surrounding at least a portion of the speaker, the plurality of surfaces having a first surface design and contour that collectively mimic a second surface design and contour of at least a portion of a load-bearing structural support member to psychoacoustically conceal the speaker when the speaker projects sound;

wherein the enclosure is capable of supporting a load in a manner substantially similar to the load-bearing structural member;

wherein the load-bearing structural support member is a corbel;

wherein the plurality of surfaces include a first planar surface having a cutout for receiving the speaker, a second planar surface parallel to the first planar surface, a third planar surface that is perpendicular to the first and second surfaces and abuts the first and second surfaces, a fourth planar surface that abuts the first, second, and third surfaces, a fifth planar surface that is perpendicular to each of the first, second, and third surface, and abuts each of the first, second, third, and fourth surface to form the enclosure;

wherein an exterior face of the fifth surface includes a volute;

wherein the enclosure further comprises a visually opaque scrim mounted to an exterior face of the first surface, the scrim having a plurality of apertures, a density of the plurality of apertures being greater in regions of the scrim that are in front of a portion of the speaker that projects sound than in regions of the scrim that are not in front of the portion of the speaker that projects sound; and wherein the plurality of apertures are constructed and arranged to image a pattern of material from which the load bearing structural support member is conventionally produced.

8. The enclosure of claim 7, wherein each of the plurality of apertures has a shape and a size, and at least one of the shape and size of the plurality of apertures is varied to reduce moire effects caused by a spatial repetition of regularly sized and shaped apertures.

9. The enclosure of claim 7, wherein the scrim has a first surface, and wherein the scrim includes:

a graphical pattern disposed on the first surface of scrim, the graphical pattern including a higher resolution image of the pattern of material from which the load bearing structural support member is conventionally produced than that conveyed by the plurality of apertures alone.

10. An enclosure for an audio speaker, comprising:

a plurality of surfaces surrounding at least a portion of the speaker, the plurality of surfaces having a first surface design and contour that collectively mimic a second surface design and contour of at least a portion of a load-bearing structural support member to psychoacoustically conceal the speaker when the speaker projects sound;

wherein the enclosure is capable of supporting a load in a manner substantially similar to the load-bearing structural member;

wherein the load-bearing structural support member is a corbel;

wherein the plurality of surfaces include a first planar surface having a cutout for receiving the speaker, a second planar surface parallel to the first planar surface, a third planar surface that is perpendicular to the first and second surfaces and abuts the first and second surfaces, a fourth planar surface that abuts the first, second, and third surfaces, a fifth planar surface that is perpendicular to each of the first, second, and third surface, and abuts each of the first, second, third, and fourth surface to form the enclosure;

wherein an exterior face of the fifth surface includes a volute; and wherein the fourth surface includes a rectangular shelf to support an object in a horizontal position, the enclosure further comprising a bracket, mounted to the third surface, for attaching the enclosure to a vertical support member.

11. An enclosure for an audio speaker, comprising:

a plurality of surfaces surrounding at least a portion of the speaker, the plurality of surfaces having a first surface design and contour that collectively mimic a second surface design and contour of at least a portion of a load-bearing structural support member to psychoacoustically conceal the speaker when the speaker projects sound;

wherein the enclosure is capable of supporting a load in a manner substantially similar to the load-bearing structural member;

wherein the load-bearing structural support member is a corbel;

wherein the plurality of surfaces include a first planar surface having a cutout for receiving the speaker, a second planar surface parallel to the first planar surface, a third planar surface that is perpendicular to the first and second surfaces and abuts the first and second surfaces, a fourth planar surface that abuts the first, second, and third surfaces, a fifth planar surface that is perpendicular to each of the first, second, and third surface, and abuts each of the first, second, third, and fourth surface to form the enclosure;

wherein an exterior face of the fifth surface includes a volute; and wherein the fourth surface includes a pentagonal shelf to support an object in a horizontal position, the enclosure further comprising a bracket, mounted to the third surface, for attaching the enclosure to at least one vertical support member of a pair of approximately perpendicular vertical support members.

12. An enclosure for an audio speaker, comprising:

a plurality of surfaces surrounding at least a portion of the speaker, the plurality of surfaces having a first surface design and contour that collectively mimic a second surface design and contour of at least a portion of a load-bearing structural support member to psychoacoustically conceal the speaker when the speaker projects sound;

wherein the enclosure is capable of supporting a load in a manner substantially similar to the load-bearing structural member;

wherein the plurality of surfaces include a visually opaque scrim that conceals the speaker from view, the scrim having a plurality of apertures, a density of the plurality of apertures being greater in regions of the scrim that are in front of a portion of the speaker that projects sound than in regions of the scrim that are not in front of the portion of the speaker that projects sound; and wherein the plurality of apertures are constructed and arranged to image a pattern of material from which the load bearing structural support member is conventionally produced.

13. The enclosure of claim 12, wherein each of the plurality of apertures has a shape and a size, and at least one of the shape and size of the plurality of apertures is varied to reduce moire effects caused by a spatial repetition of regularly sized and shaped apertures.

14. The enclosure of claim 13, wherein the scrim has a first surface, and wherein the scrim includes:

a graphical pattern disposed on the first surface of scrim, the graphical pattern including a higher resolution image of the pattern of material from which the load bearing structural support member is conventionally produced than that conveyed by the plurality of apertures alone.

15. An enclosure for concealing at least one speaker element of an audio speaker, comprising:

a visually opaque scrim that covers a portion of the audio speaker that includes the at least one speaker element, the scrim having a plurality of apertures, a density of the plurality of apertures being greater in regions of the scrim that are in front of the at least one speaker element than in regions of the scrim that are not in front of the at least one speaker element;

wherein the plurality of apertures are constructed and arranged to form a bitonal image.

16. The enclosure of claim 15, wherein the bitonal image is a pattern that occurs in nature.

17. The enclosure of claim 15, wherein the bitonal image is a pattern of at least one of wood, stone, and animal hide.

18. The enclosure of claim 15, wherein the enclosure has a first outwardly visible surface design and contour that mimics a second outwardly visible surface design and contour of a structural member, and wherein the plurality of apertures are constructed and arranged to form the bitonal image of a material from which the structural member is conventionally produced.

19. The enclosure of claim 18, wherein each of the plurality of apertures has a shape and a size, and at least one of the shape and size of the plurality of apertures is varied to reduce moire effects caused by a spatial repetition of regularly sized and shaped apertures.

20. The enclosure of claim 19, wherein the scrim has a first surface, the enclosure further comprising:

a graphical pattern disposed on the first surface of scrim, the graphical pattern including a higher resolution image of the bitonal image formed by the plurality of apertures than that conveyed by the plurality of apertures alone.

21. The enclosure of claim 20, wherein the graphical pattern is aligned with the bitonal image formed by the plurality of apertures so that portions of the graphical pattern that contrast with portions of the bitonal image formed by the plurality of apertures avoid each of the plurality of apertures.

22. The enclosure of claim 15, wherein each of the plurality of apertures forms dark regions of the bitonal image and the scrim forms light regions of the bitonal image.

23. The enclosure of claim 15, wherein each of the plurality of apertures has a shape and a size, and at least one of the shape and size of the plurality of apertures is varied to reduce moire effects caused by a spatial repetition of regularly sized and shaped apertures.

24. The enclosure of claim 15, wherein the scrim has a first surface, the enclosure further comprising:

a graphical pattern disposed on the first surface of scrim, the graphical pattern including a higher resolution image of the bitonal image formed by the plurality of apertures than that conveyed by the plurality of apertures alone.

25. The enclosure of claim 24, wherein the graphical pattern is aligned with the bitonal image formed by the plurality of apertures so that portions of the graphical pattern that contrast with portions of the bitonal image formed by the plurality of apertures avoid each of the plurality of apertures.

26. The enclosure of claim 15, wherein the scrim is formed from a rigid material having a maximum amount of surface area that can be removed by perforation without losing structural integrity, and wherein a maximum density of the plurality of apertures is set below the maximum amount.

27. The enclosure of claim 15, further comprising:

a substantially hollow elongate enclosure to support the at least one speaker element, the enclosure having a first end and a second end;

means for retaining the at least one speaker element in the enclosure; and a capital relief element coupled to the first end of the enclosure and a base relief element coupled to the second end of the enclosure, the capital and base relief elements forming at least a fraction of an architectural column;

wherein the scrim circumferentially surrounds a portion of the enclosure between the capital and base relief elements.

28. The enclosure of claim 27, wherein a superior surface of the capital relief element includes an essentially horizontal and substantially planar surface, whereby objects can be displayed.

29. The enclosure of claim 28, wherein the essentially horizontal and substantially planar surface is an uppermost portion of an abacus having the approximate shape of a rectangular solid, and wherein an underside of the abacus is incused with a groove that is proximal to and inset from a perimeter of the abacus to shed fluids drawn by gravity predominantly at the perimeter.

30. The enclosure of claim 27, wherein the capital and base relief elements form one half of an architectural column.

31. The enclosure of claim 27, wherein the capital and base relief elements form greater than one half of an architectural column, the greater than one half of the architectural column representing a larger part of an unequal division of an imagined whole column by a longitudinal plane, an intersection of the imagined whole column and the longitudinal plane defining a planar surface on the greater than one half of the architectural column, the planar surface having at least one opening into an interior of the enclosure that is dimensioned to receive the at least one speaker element, and wherein the audio speaker operates as a reflecting speaker.

32. The enclosure of claim 27, wherein at least one of the capital and base relief elements are distressed to form a deteriorated fraction of an architectural column.

33. The enclosure of claim 27, wherein the capital and base relief elements form a pilaster.

34. The enclosure of claim 27, wherein the capital and base relief elements are constructed and arranged to depict frame-and-panel casing.

35. The enclosure of claim 27, wherein the capital and base relief elements form a complete architectural column, and wherein the at least one speaker element includes at least three speaker elements that project acoustical energy in different directions.

36. A method of concealing an audio speaker having at least one speaker element, comprising the steps of:

forming a speaker enclosure having an outwardly visible shape that suggests an object other than a rectangularly shaped audio speaker;

operatively mounting the at least one speaker in the speaker enclosure;

selecting a pattern that is characteristically associated with an outward appearance of the object;

perforating a visually opaque sheet of material to form a bitonal image of the pattern in the sheet of material; and covering the at least one speaker element with the perforated sheet of material.

* * * * *